US008574131B2

(12) United States Patent
Daly et al.

(10) Patent No.: US 8,574,131 B2
(45) Date of Patent: Nov. 5, 2013

(54) SENSING APPLICATIONS FOR EXERCISE MACHINES

(71) Applicants: Juliette C. Daly, Arlington Heights, IL (US); Casparus Cate, Batavia, IL (US); Glenn Allen DeYoung, Geneva, IL (US)

(72) Inventors: Juliette C. Daly, Arlington Heights, IL (US); Casparus Cate, Batavia, IL (US); Glenn Allen DeYoung, Geneva, IL (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 13/770,729

(22) Filed: Feb. 19, 2013

(65) Prior Publication Data

US 2013/0165297 A1 Jun. 27, 2013

Related U.S. Application Data

(63) Continuation of application No. 13/416,722, filed on Mar. 9, 2012, now Pat. No. 8,403,814, which is a continuation of application No. 13/039,897, filed on Mar. 3, 2011, now Pat. No. 8,157,708, which is a continuation of application No. 12/176,068, filed on Jul. 18, 2008, now Pat. No. 7,914,420.

(60) Provisional application No. 60/950,516, filed on Jul. 18, 2007.

(51) Int. Cl.
*A63B 24/00* (2006.01)

(52) U.S. Cl.
USPC ..... 482/9; 482/8; 482/51; 482/54

(58) Field of Classification Search
USPC ..... 482/1–9, 51, 54, 900–902; 434/247; 119/700
See application file for complete search history.

(56) References Cited

U.S. PATENT DOCUMENTS

| | | | |
|---|---|---|---|
| 4,367,752 | A | 1/1983 | Jimenez et al. |
| 4,774,679 | A | 9/1988 | Carlin |
| 4,974,831 | A | 12/1990 | Dunham |
| 5,365,934 | A | 11/1994 | Leon et al. |

(Continued)

FOREIGN PATENT DOCUMENTS

| | | |
|---|---|---|
| EP | 1743677 | 1/2007 |

OTHER PUBLICATIONS

United States Patent and Trademark Office, "Supplemental Notice of Allowance," issued in connection with U.S. Appl. No. 12/176,068, mailed Jan. 6, 2011, 6 pages.

(Continued)

*Primary Examiner* — Glenn Richman
(74) *Attorney, Agent, or Firm* — Hanley, Flight & Zimmerman, LLC.

(57) ABSTRACT

Methods for profiling exercise sessions are described. An example method of determining cadence of a user disclosed herein includes receiving output signals from a sensor generated in response to consecutive footfalls of the user impacting a deck of a treadmill during an exercise session and processing the output signals from the sensor to determine respective magnitude values of a peak or a trough value of each of the output signals. The method includes detecting whether a first output signal has a first peak or trough value and detecting whether a second output signal has a second peak or trough value, determining a time interval between the first peak or trough value detected and the second peak or trough value detected, and calculating a cadence value of the user based on the time intervals.

25 Claims, 19 Drawing Sheets

(56) References Cited

U.S. PATENT DOCUMENTS

| | | | | |
|---|---|---|---|---|
| 5,368,532 | A | 11/1994 | Farnet | |
| 5,369,601 | A | 11/1994 | Tannenbaum | |
| 5,382,207 | A | 1/1995 | Skowronski et al. | |
| 5,474,087 | A | 12/1995 | Nashner | |
| 5,485,402 | A | 1/1996 | Smith et al. | |
| 5,516,334 | A | 5/1996 | Easton | |
| 5,524,637 | A | 6/1996 | Erickson | |
| 5,623,944 | A | 4/1997 | Nashner | |
| 5,976,061 | A | 11/1999 | Moon et al. | |
| 5,993,401 | A | 11/1999 | Inbe et al. | |
| 6,298,314 | B1 | 10/2001 | Blackadar et al. | |
| 6,645,126 | B1 * | 11/2003 | Martin et al. | 482/54 |
| 7,353,137 | B2 | 4/2008 | Vock et al. | |
| 7,591,795 | B2 | 9/2009 | Whalen et al. | |
| 7,914,420 | B2 | 3/2011 | Daly et al. | |
| 8,157,708 | B2 | 4/2012 | Daly et al. | |
| 8,403,814 | B2 | 3/2013 | Daly et al. | |
| 2002/0130951 | A1 | 9/2002 | Kurono | |
| 2003/0013584 | A1 | 1/2003 | Harney et al. | |
| 2005/0039541 | A1 | 2/2005 | Kurono | |
| 2005/0075213 | A1 * | 4/2005 | Arick | 482/1 |
| 2006/0183603 | A1 | 8/2006 | Astilean | |
| 2009/0023556 | A1 | 1/2009 | Daly et al. | |
| 2010/0113222 | A1 | 5/2010 | Radow | |
| 2011/0190097 | A1 | 8/2011 | Daly et al. | |
| 2012/0165159 | A1 | 6/2012 | Daly et al. | |

OTHER PUBLICATIONS

United States Patent and Trademark Office, "Notice of Allowance," issued in connection with U.S. Appl. No. 12/176,068, mailed Nov. 22, 2010, 13 pages.

United States Patent and Trademark Office, "Non-Final Office Action", issued in connection with U.S. Appl. No. 12/176,068, mailed Jun. 11, 2010, 13 pages.

United States Patent and Trademark Office, "Restriction Requirement," issued in connection with U.S. Appl. No. 12/176,068, mailed Feb. 24, 2010, 6 pages.

United States Patent and Trademark Office, "Notice of Allowance," issued in connection with U.S. Appl. No. 13/039,897, mailed Jan. 4, 2012, 9 pages.

United States Patent and Trademark Office, "Non-Final Office Action", issued in connection with U.S. Appl. No. 13/039,897, mailed Sep. 16, 2011, 13 pages.

United States Patent and Trademark Office, "Restriction Requirement," issued in connection with U.S. Appl. No. 13/039,897, mailed Aug. 4, 2011, 5 pages.

United States Patent and Trademark Office, "Notice of Allowance," issued in connection with U.S. Appl. No. 13/416,722, mailed Nov. 19, 2012, 9 pages.

United States Patent and Trademark Office, "Non-Final Office Action," issued in connection with U.S. Appl. No. 13/416,722, mailed Jul. 26, 2012, 14 pages.

* cited by examiner 3.0 MPH

Treadmill Cadence vs. Speed

| Tread Belt Speed (mph) | Steps per Minute (left & right foot) | | | | | | | | | |
|---|---|---|---|---|---|---|---|---|---|---|
| | User 1 Light | User 2 Medium | User 3 Standard | User 4 Strong | User 5 Heavy | | Min | Max | Δ | Average |
| 0.5 | 36 | 28 | 47 | 52 | 30 | Walk | 28 | 52 | 24 | 38 |
| 1 | 60 | 50 | 64 | 65 | 62 | | 50 | 65 | 15 | 60 |
| 2 | 98 | 83 | 88 | 101 | 86 | | 83 | 101 | 18 | 91 |
| 3 | 120 | 95 | 100 | 112 | 107 | | 95 | 120 | 25 | 107 |
| 4 | 133 | 120 | 115 | 122 | 120 | | 115 | 133 | 18 | 122 |
| 5 | | 136 | | 133 | | | 133 | 136 | 3 | 135 |
| 5 | 146 | 146 | 146 | 146 | 143 | Run | 143 | 146 | 3 | 146 |
| 6 | 154 | 146 | 150 | 146 | 150 | | 146 | 154 | 8 | 149 |
| 7 | 158 | 146 | 154 | 150 | 158 | | 146 | 158 | 12 | 153 |
| 8 | 167 | 150 | 158 | 154 | 167 | | 150 | 167 | 17 | 159 |
| 9 | 176 | 154 | 167 | 158 | 169 | | 154 | 176 | 23 | 165 |
| 10 | 182 | 158 | 176 | 162 | 176 | | 158 | 182 | 24 | 171 |
| 11 | 200 | 162 | 182 | 171 | | | 162 | 200 | 38 | 179 |
| 12 | 219 | 171 | | 188 | | | 171 | 219 | 48 | 193 |

SENSING APPLICATIONS FOR EXERCISE MACHINES

CROSS REFERENCE TO RELATED APPLICATIONS

This patent arises from a continuation of U.S. patent application Ser. No. 13/416,722, filed on Mar. 9, 2012, which is a continuation of U.S. patent application Ser. No. 13/039,897, filed Mar. 3, 2011, now U.S. Pat. No. 8,157,708, which is a continuation of U.S. patent application Ser. No. 12/176,068, filed Jul. 18, 2008, now U.S. Pat. No. 7,914,420, which claims priority to U.S. Provisional Patent Application No. 60/950,516, filed on Jul. 18, 2007, all of which are hereby incorporated by reference in their entireties.

FIELD OF DISCLOSURE

The present disclosure relates generally to sensing applications and, more particularly, to sensing applications for exercise machines.

BACKGROUND

Exercise machines such as, for example, treadmills, typically provide feedback information or results from the exercise session to a user that include, for example, duration, speed, incline, caloric expenditure, etc. However, many treadmills fail to provide substantive feedback information or results from the exercise session that may be used to profile the user's exercise session. For example, treadmills typically do not give substantial feedback to the user regarding gait performance (e.g., cadence, stride length, etc.). Most users probably lack knowledge and/or information to determine what their stride length is during walking or running exercise sessions. Knowledge of one's stride length and/or cadence rate may be used to provide stride training, cadence training, and/or increase in metabolic cost during the exercise session.

Some known treadmills provide feedback information showing the caloric expenditure for a give exercise session. However, the caloric equations are currently based on an average expenditure model (depending on body weight, speed, and incline) and, thus, do not reflect the individual or personal characteristics of the users. Furthermore, some treadmills currently employ two different equations to calculate caloric expenditure such as, for example, the equations recommended by the American College of Sports Medicine (ACSM). A first equation is used to determine caloric expenditure for walking speeds and a second equation is used to determine caloric expenditure for running speeds. These equations, however, are often loosely defined in terms of applicable speed ranges (assuming the exerciser or user will know whether they are walking or running and decide which equation to use). Some treadmills arbitrarily decide on a transition point to decide between the two equations. For instance, some treadmills utilize a universal speed of 4.5 miles per hour (mph) as an average transition speed that most users will switch from walking to running gaits. However, it is known that there can be variation from person to person in terms of transition speed, and some users may question the sudden change in caloric expenditure rate at 4.5 mph, particularly if the user is still walking at higher speeds or if they are jogging/running at lower speeds.

Still further, some treadmills include a flexible deck to help cushion a user's footfall on the deck or equipment. These treadmills typically include a fixed flexibility setting because users may not know what stiffness setting is best to use for their workout and may be confused by the adjustment choices. Other known treadmills enable a user to select the deck stiffness value. However, users often choose deck stiffness settings that do not fit their workout and personal characteristics.

Additionally, some commercial and/or residential treadmills provide the ability to determine a user's heart rate via biopotential sensors. In some instances, however, a user may have trouble reading their heart rate due to a variety of factors. For example, a user's cadence may be a regular repeating pattern that can generate electrical noise that may interfere with obtaining an accurate signal reading from the biopotential sensors.

DETAILED DESCRIPTION

Figure 1:
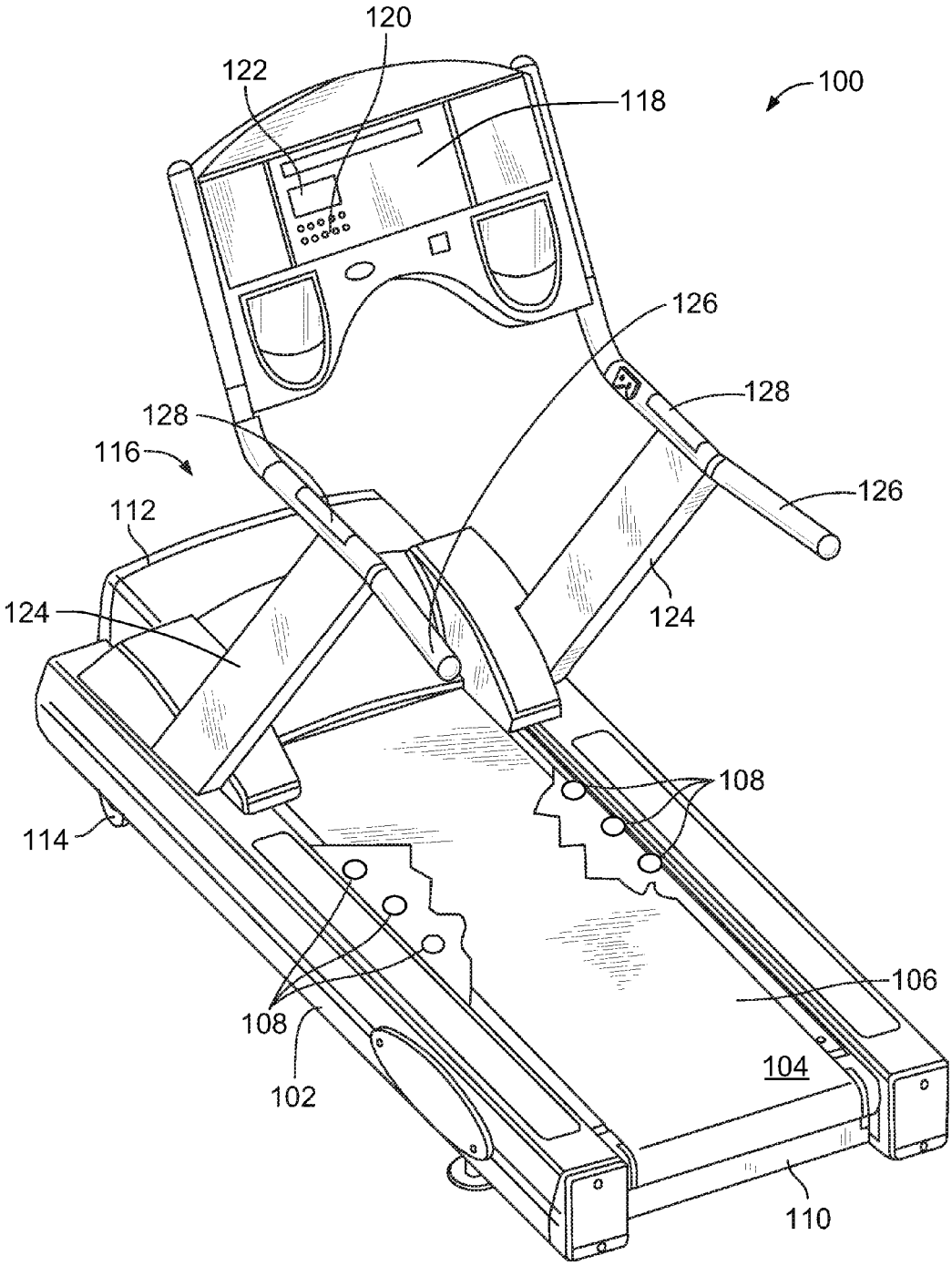
FIG. 1 illustrates an example exercise machine described herein.

The following descriptions of the disclosed examples are not intended to limit the scope of this disclosure to the precise form or forms detailed herein. Instead the following descriptions are intended to be illustrative of the principles of the disclosure so that others may follow its teachings.

The example methods described herein use sensing applications to display and/or profile an exerciser's workout regimen or exercise session conducted on an exercise machine such as, for example a treadmill machine. An example treadmill machine, such as a 95 series or 97 series treadmill from LifeFitness® include piezoelectric sensors mounted around a deck support of the treadmill that respond to a deck deflection caused by a user's feet impacting a flexible deck during the exercise session. The piezoelectric sensors provide electrical output signals that correlate to the deflection of the deck caused by the user's feet impacting the deck during the exercise session. Thus, the magnitude of the piezoelectric output voltage varies with the magnitude and rate of deflection imparted on the deck by a user's feet during the exercise session.

For example, FIGS. 14A-14D are graphical illustrations of the electrical signal outputs (e.g., waveforms) generated per given time intervals during which a user's feet impact a deck when exercising on an example treadmill at speeds ranging from 2.0 MPH, 3.0 MPH, 6.0 MPH, and 8.0 MPH, respectively. The electrical signal outputs include a plurality of peaks 1402, 1406, 1410, and 1414 and a plurality of troughs 1404, 1408, 1412, and 1416. The period of time a user's foot impacts the deck is illustrated between respective peaks and troughs 1402-1416 of the graphical output. For example, time period in which a user's left foot impacts the deck is indicated between the vertical lines 1418 and 1420 of FIGS. 14A-14D. The electrical output signals from the sensors also correlate to the force of a user's foot imparted on the deck and/or the deflection of the deck caused by user's footfall impacts. In addition to the piezoelectric sensors, the methods disclosed herein may be applicable to any example footfall sensors.

The signals provided by the piezoelectric sensors described above may be used as sensing applications for the example treadmill. One sensing application of the signal outputs can be used to determine a cadence of a user. The user's cadence may be determined by counting footstrike impacts within a given time period or counting the time interval between consecutive footstrikes. Each output signal generated by the sensors generally correlates to a footstrike imparted on the deck. In some examples, the cadence of the user is displayed graphically to a user via a graphic and video monitor or display.

Additionally or alternatively, the number of footstrikes imparted on the deck may be displayed to the user to provide a step counter. Such feedback information may provide motivation to a user. For example, thirty minutes of walking at three miles per hour typically yield approximately three thousand steps and thirty minutes at running speeds typically yield approximately four thousand to five thousand steps. Furthermore, the step counter may be used to determine a user's cadence (i.e., steps per minute) by applying the value of the step counter across the duration or time interval of the exercise session.

Another sensing application determines the stride length of a user. The user's cadence can be used to determine the stride length. In one example, the stride length can be computed or determined from the measured elapsed time between footfalls (i.e., the inverse of the user's cadence), multiplied by the known belt speed of the treadmill. In one example, a graphic and video monitor or display may be utilized to display the stride length to the user. Additionally or alternatively, a user's nominal stride length can be determined by averaging the measured stride length values. The nominal stride length value for a given speed can be stored in a memory medium for a given user based on the user's physical characteristics.

Another sensing application provides a cadence and/or stride length coach. Because cadence may be measured with the example sensor output signals, a cadence coach program may enable a user to cadence interval train at a constant speed (to perhaps train for longer or shorter stride lengths, or determine one's optimal or nominal stride length). For example, an animated graphic may be utilized to show a virtual person with the same cadence as the user, to serve as a motivation, and/or even explain the biomechanics of the walking or running gaits in real time and synchronized with the user's gaits. Furthermore, in another example, a graphic illustration of the user's muscles that are active during each stance phase may be displayed to provide, for example, a real-time educational and/or motivational tool.

Furthermore, providing a user's stride length as feedback information provides another workout matrix to display and use in profiling an exercise routine. For example, the stride length could be used as feedback to train the user and/or prompt a user to shorten or lengthen their stride from their nominal stride length. Straying or deviating from a user's natural gait may enable a user to burn more calories because a user exerts more effort or utilize muscles differently to maintain the unnatural or abnormal gait. For example, intentionally walking and running with an abnormally long gait (e.g., to change stride length to 120% of nominal) has been shown to double metabolic cost during exercise. This can be used to the exerciser's advantage to intentionally avoid walking and running with normal or nominal gaits (i.e., walking or running with abnormal gaits) during an exercise session so as to burn more calories at a given speed. Still further, the example stride length coach may be combined with the cadence coach described above. For instance, a look-up table with recommended cadences may then be utilized to recommend stride lengths derived from research, surveys, and user information (height or inseam, fitness level, etc.) for different types of training or workout regimens.

Additionally or alternatively, the metabolic cost equation may be adjusted when a user intentionally alters their stride length by multiplying the metabolic cost equation by a coefficient value retrieved from a look-up table. Determining the proper coefficient may include storing the calculated or measured stride length noted above as the nominal stride length for that user at that speed. The stored nominal stride length is compared to an average stride length based on the user's physical characteristics and the speed of the treadmill. The calculated stride length may be compared to the average gait established for the belt speed and a user (from a look-up table) and/or may be calculated from stored stride length values obtained during the exercise session. A calculated absolute difference between the between the nominal stride length and the average stride length may be used to determine a bipedal caloric coefficient for the horizontal component of the walk/run metabolic cost equation calculations, adding an extra dimension to enhance caloric expenditure accuracy. The bipedal caloric coefficient is multiplied by the horizontal component part of the ACSM caloric calculation equation, as to increase the accuracy of $VO_2$ estimation for walking and running.

Another sensing application may utilize the output signals of the example sensors described herein to determine whether a user is running or walking and, thus, apply the proper American College of Sports Metabolic expenditure equation to calculate the user's caloric expenditure during the exercise session. Both of the metabolic estimate equations offer a single term for a horizontal component based on speed, and a vertical component based on incline percentage. The resultant metabolic cost is multiplied by user body weight and the distance traveled to compute the accumulated metabolic cost or caloric expenditure for during an exercise session.

Figure 14A:
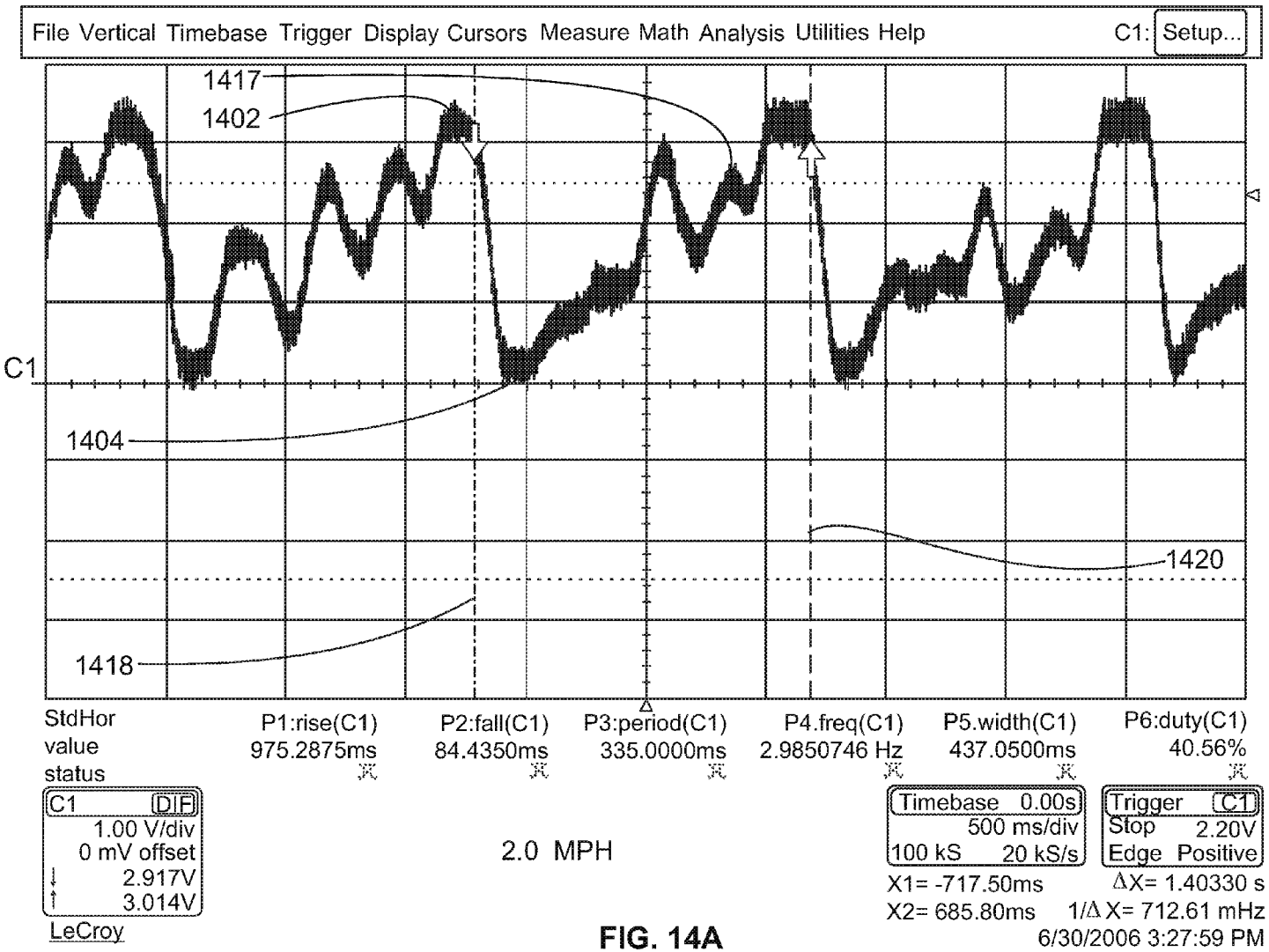
FIGS. 14A-14D are example voltage waveform depictions of sensor outputs representing an example user's foot-falls at various treadmill speeds.
Figure 14B:
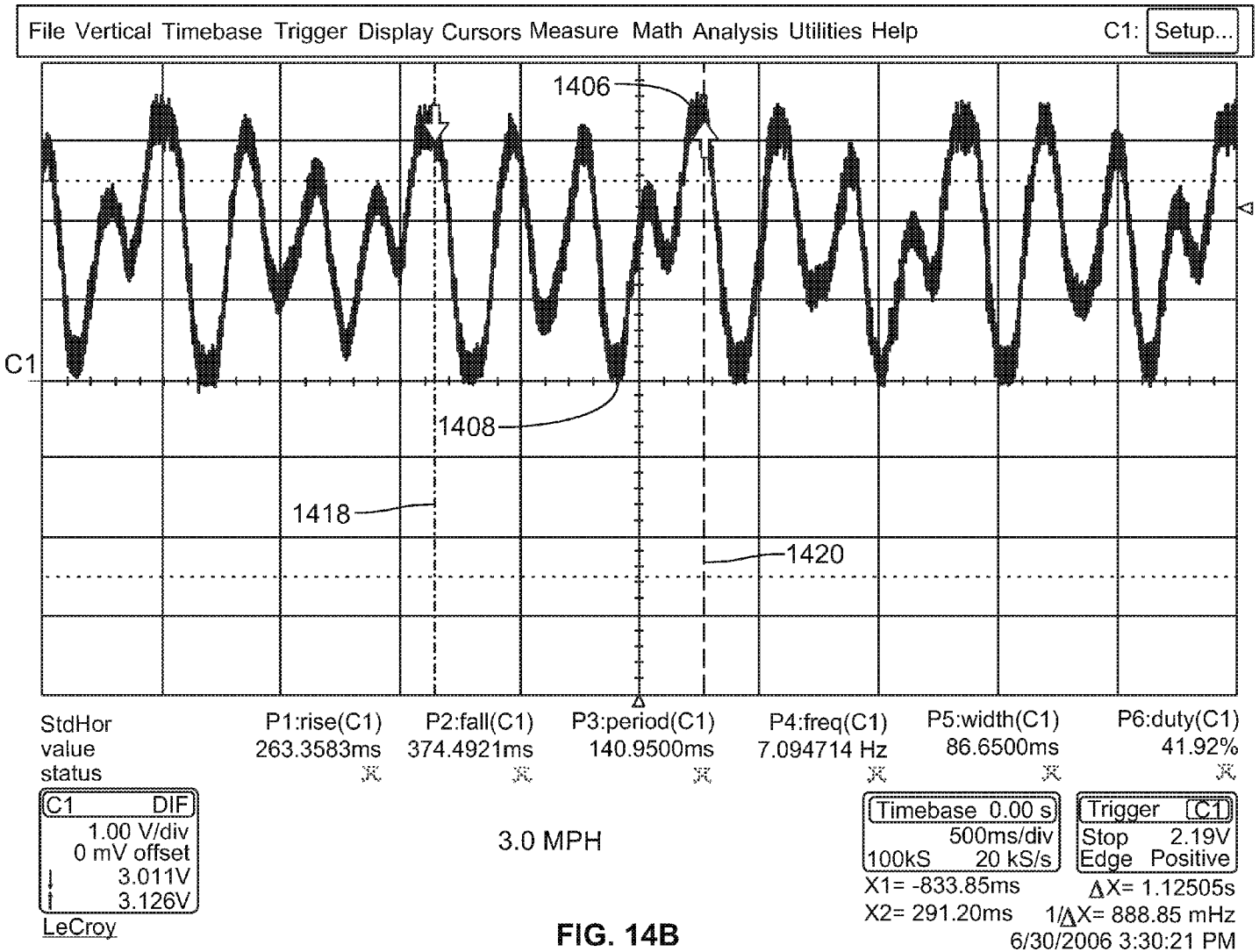
Figure 14C:
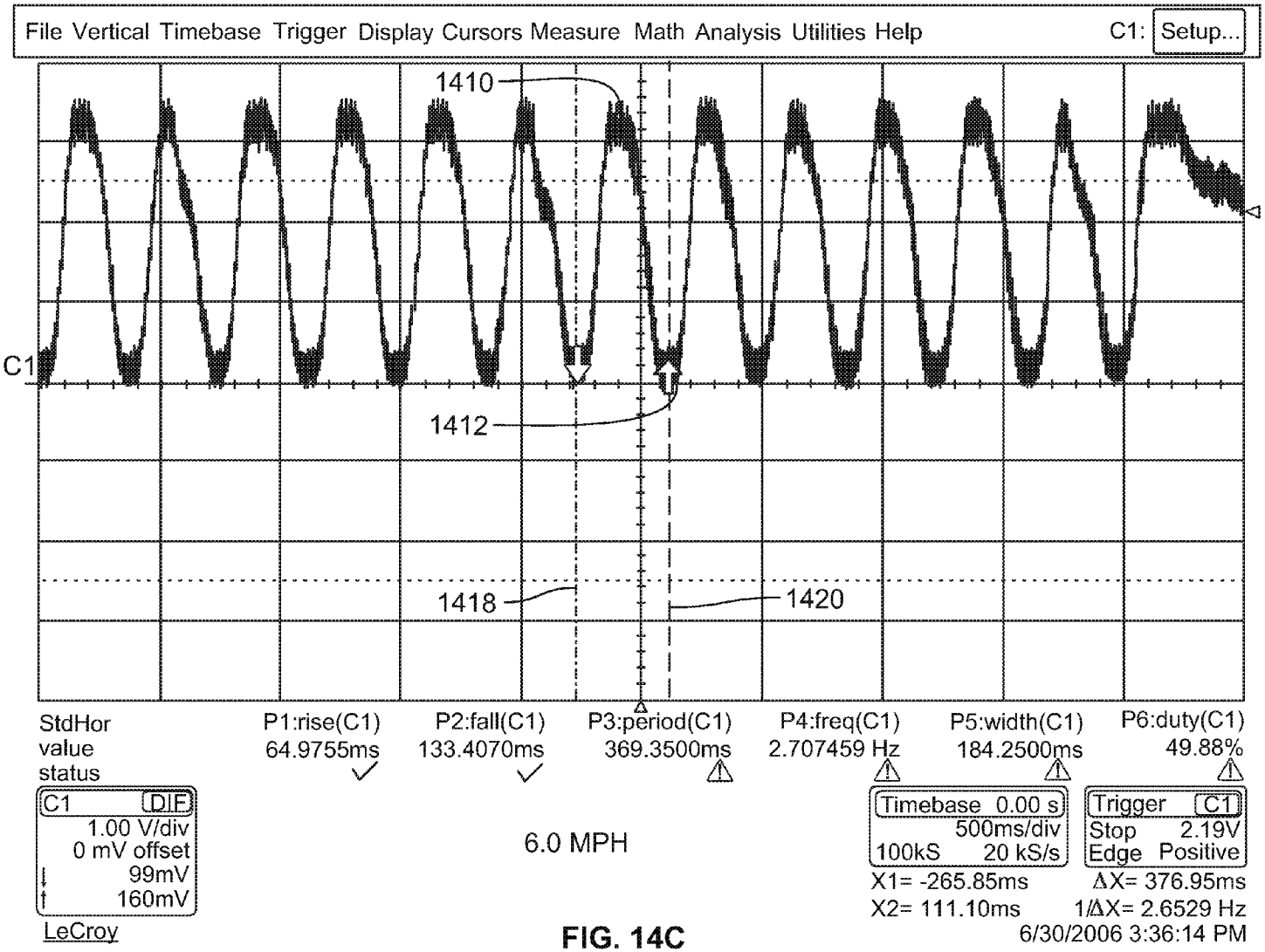
Figure 14D:
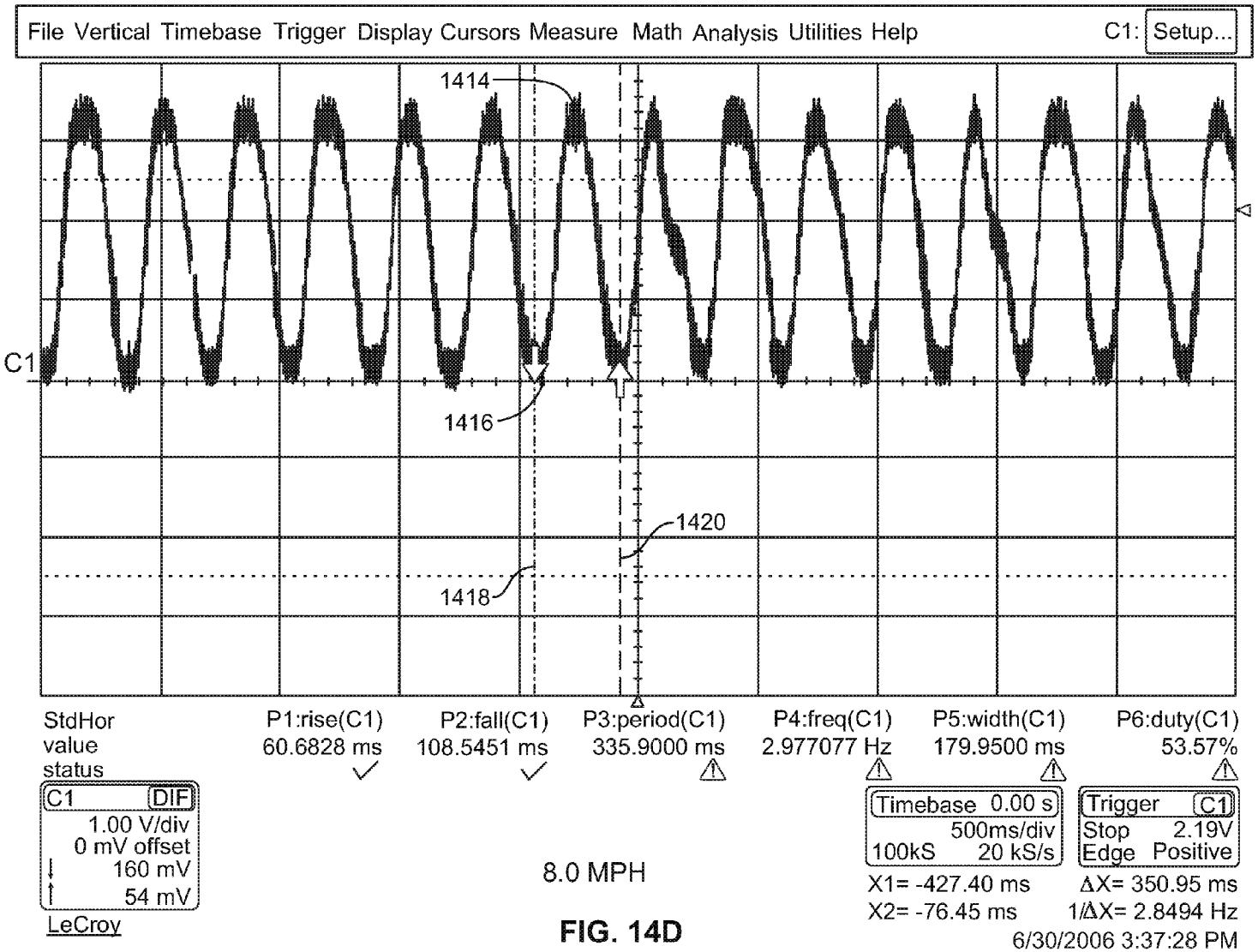
Figure 15:
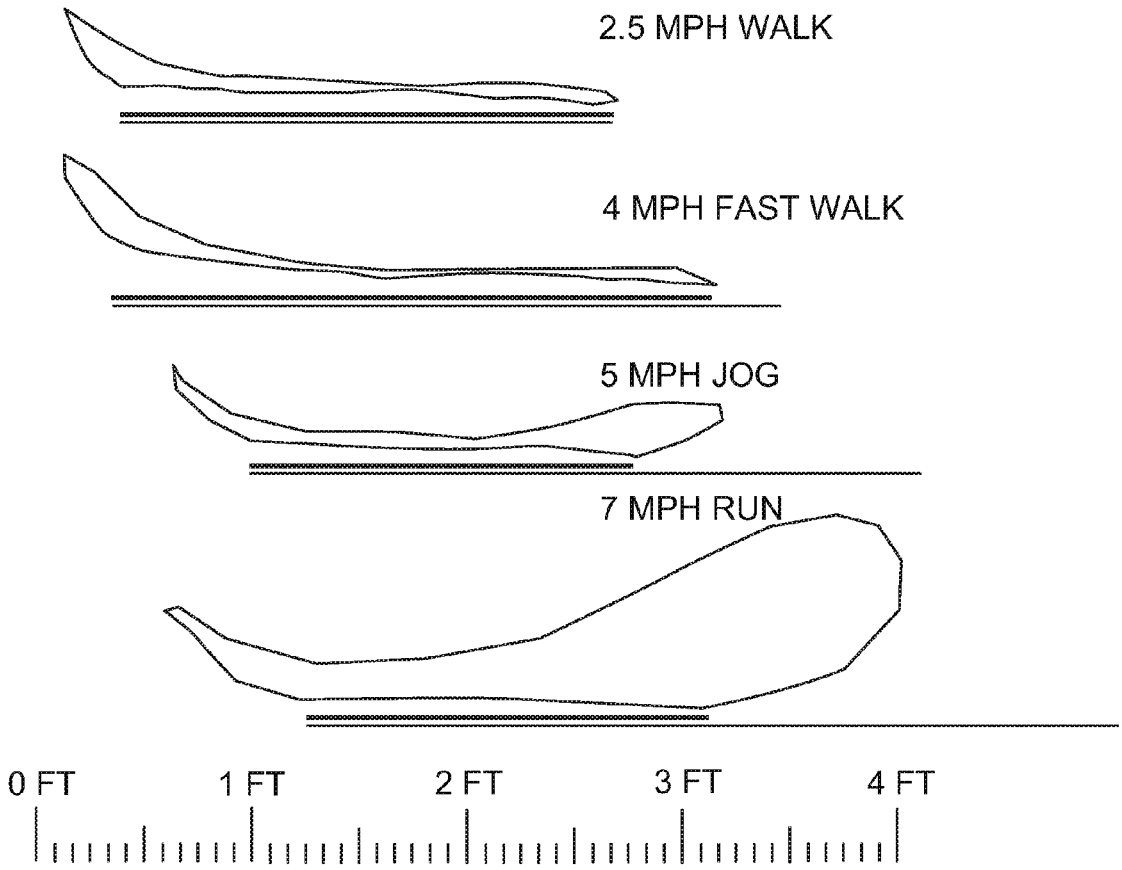
FIG. 15 is a graph showing the side view metatarsal trajectory of a user of a treadmill at various speeds.

The transition between the walking and running calorie equations may be determined by using each individual's actual transition speed to decide which equations to apply rather than using an arbitrary average speed (e.g., an arbitrary speed of 4.5 mph). The difference in waveform characteristics from the sensor output signal between walking and running gaits can be used to determine whether the user is running or walking and, thus, select the appropriate metabolic expenditure equation to calculate caloric expenditure. FIGS. 14A-14D, illustrate an example waveform characteristic of the sensor output signals during which a user's feet impact the deck when exercising on an example treadmill at speeds ranging from 2.0 MPH, 3.0 MPH, 6.0 MPH, and 8.0 MPH, respectively. Additionally, for example, FIG. 15 illustrates a graph showing a side view metatarsal trajectory of a user of a treadmill at various speeds. The graph illustrates how contact length of a user's foot with the deck suddenly shortens as the user transitions from a walking gait at 4 mph to a jogging gait at 5 mph. The reduction in contact length is balanced by the introduction of the airborne period as the user transitions between walking and running.

Another sensing application may provide deck stiffness adjustment. Flexible decks provide a cushion or softer impact to alleviate stress on a user's body (e.g., a person's knee joints). The magnitude of the output signal correlates with the magnitude and rate of deflection imparted on the deck by a user's feet. Knowing that deflection is related to deceleration, it is possible to set multiple thresholds based on deflection and the user's weight, speed, and/or incline, to correlate to and adjust the flexible deck stiffness settings.

Proper deck stiffness values may be determined by comparing measured deck stiffness values to flexdeck threshold values. To determine threshold flexdeck settings, the heelstrike phase is determined. Because the biomechanics of running are well documented, reasonable estimates exist for the amount of time a user's feet are in the heelstrike, midstance, and propulsion phases based on their cadence. Thus, knowing the cadence, the approximate time spent in the heelstrike phase can be calculated. Furthermore, an improved approximation of the heelstrike phase time may be determined by measuring the duty factor using the relative duty cycle of the footfall sensor. During a footfall event, there is a distinct period of compression and rebound as the foot pressure exceeds the threshold of the footfall measuring system. Whatever this threshold is, so long as it is isotropic with compression and rebound, it can be used to measure duty cycle. The duty cycle of the output correlates directly with the duty factor of running or walking. For example, walking is typically above 0.55, and running below 0.4.

Once the heelstrike phase time is determined, the threshold deck stiffness settings may be determined. The output of the example sensor provides a signal that correlates to the force magnitude imparted on the deck by the user's feet during the exercise session. The derivative of this force over the approximate heelstrike phase time may be used to determine the impact loading experienced by a given user based on their physical characteristics and/or workout parameters. Deck deflection thresholds for deck stiffness settings may be derived to correlate to impact loading magnitude ranges. These derived deflection thresholds may be utilized to automatically adjust the deck stiffness of the deck based on a user's gait input and, thus, eliminate problems associated with user confusion or inexperience.

Another sensing application may determine if a user is present on the treadmill deck. For example, the signal output generated by the sensors may indicate that a user is no longer on the deck, thus triggering a power-saving shut-down of a control system, or may indicate that the user is present on the deck and activate the control system from standby status.

Still another sensing application may be used to assist in filtering noise from a measured heart rate. In particular, the example signal outputs of the sensors provide reliable signals at various speeds and inclines. However, the cadence (i.e., both left and right footfalls) of an exerciser can often fall in or near the typical heart rate ranges, particularly above treadmill speeds of about 2 mph. Thus, a user's cadence that falls in or near the typical heart rate ranges may often cause electrical noise, which may interfere or complicate reading the output signals from the biopotential sensors when determining the user's heart rate.

Although the average cadence range may overlap heavily with the typical heart rate range, in many cases, there is enough difference in cadence versus heart rate that a distinguishing condition helps to improve heart rate accuracy. Because cadence can be measured with the example sensing applications described herein, the cadence measurement can be used as a condition in a heart rate autocorrelation routine that causes the algorithm not to misinterpret strong signals at the cadence frequency. In other words, the sensor output signals may be filtered from the sensing application used to determine a user's heart rate and, thus, to assist in the determination of the user's heart rate.

Figure 16:
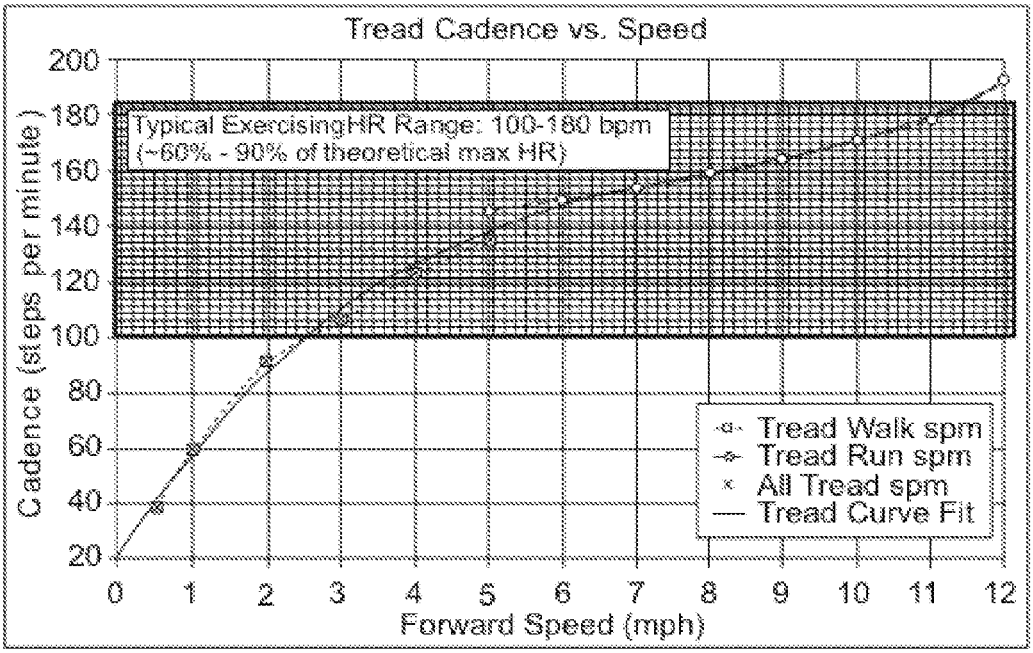
FIG. 16 is an example chart and graph of various treadmill users' cadence versus a treadmill speed.

For example, FIG. 16 illustrates an example data chart and graph of various treadmill users' cadence versus a treadmill speed. The data shows that users may have a cadence of approximately 120 steps per minute during a 3.5 mph walk, and a typical HR at this cadence may be in the range of 105-110 bpm. In this example, it may be difficult to determine the difference between the heart rate signal and noise generated from a user's foot impacting the deck (i.e., the user's cadence). Filtering a heart rate sensing application to condition or ignore the periodic cadence pattern of 120 steps/min typically causes the 110 beats/min heart rate signal to be detected with greater accuracy and, thus, improve the accuracy of the heart rate sensing application.

Turning now to FIG. 1, an exercise machine described herein is depicted as an example treadmill 100. Although the example exercise machine is depicted as a treadmill, in other examples, other exercise machines may include elliptical machines, step machines, or any other suitable exercise machine(s). The example treadmill 100 includes a base 102 that houses a platform or deck 104. A belt 106, on which a user may walk, jog, and/or run, moves over the deck 104. The deck 104 includes at least one sensor 108 such as, for example, a plurality of sensors 108. The sensors 108 may be any suitable sensors including, for instance, piezoelectric sensors that provide output signals in response to deformation or deflection, such as, for example, deformation or deflection of the deck 104 caused by an impact of a user's feet on the deck 104. The sensors 108 are operatively coupled to a deck support (not shown) and produce electrical signals (e.g., voltage signals) that are proportional to the deflection of the deck 104 caused by the force of the user's feet impacting the deck 104. Although the sensors are illustrated as piezoelectric sensors 108, the sensors 108 may be any other sensors such as for example, footfall sensors, force plates, etc., that provide an output signal that correlate to the force imparted to the deck 104 by the user's feet as the user operates the treadmill 100. The base 102 includes a pivot end 110 and an incline end 112, which may be raised and/or lowered to various heights based on user settings and/or programmed training routines via, for example, an actuator mechanism 114. A drive member (not shown) such as, for example, a motor, rotatably drives the belt 106 and is operatively coupled to the belt 106 via, for example, pulleys drive transmission, etc. The example drive member and the incline actuator mechanism 114 are enclosed in a housing 116.

The treadmill 100 may also include a deck stiffness adjustor (not shown), which can adjust the flexibility of the deck 104 to provide varying degrees of deflection. For example, the treadmill 100 may include arc-shaped leaf springs that support the deck and are operatively coupled to an adjustment mechanism such as, for example, an actuator that expends the leaf springs to provide greater flexibility to the deck 104, and retracts the leaf springs to provide greater stiffness to the deck 104. Adjusting the stiffness of the deck provides comfort for users having different physical characteristics and/or walking/running styles.

The example treadmill 100 also includes a control unit 118 having a user interface 120. In the illustrated example, the control unit 118 controls the drive member, the incline adjustor, and the deck stiffness adjustor. The control unit 118 also includes a display 122 to provide feedback information to the user. For example, the display 122 may provide feedback information relating to the belt speed, caloric expenditure, inclination setting, etc.

The example treadmill 100 also includes vertical rails 124 mounted to the base 102 and adapted to support the control unit 118 and the user interface 120 components. Additionally, the vertical rails 124 provide support for arms 126 that extend generally perpendicular from the vertical rails 124 and which are generally parallel with the base unit 102. The example arms 126 allow the user to support himself/herself while walking, jogging, and/or running on the moving belt 106 and deck 104. The arms 126 include biopotential sensors 128 such as, for example, electrode sensors to measure, detect, or monitor a physiological condition (e.g., a heart rate) of a user. The example sensors 128 detect physiological signals such as, for example, electrical voltages or potentials generated by a user through physical contact with the user's skin. The user's heart rate may be provided to the user via the display 122.

Figure 2:
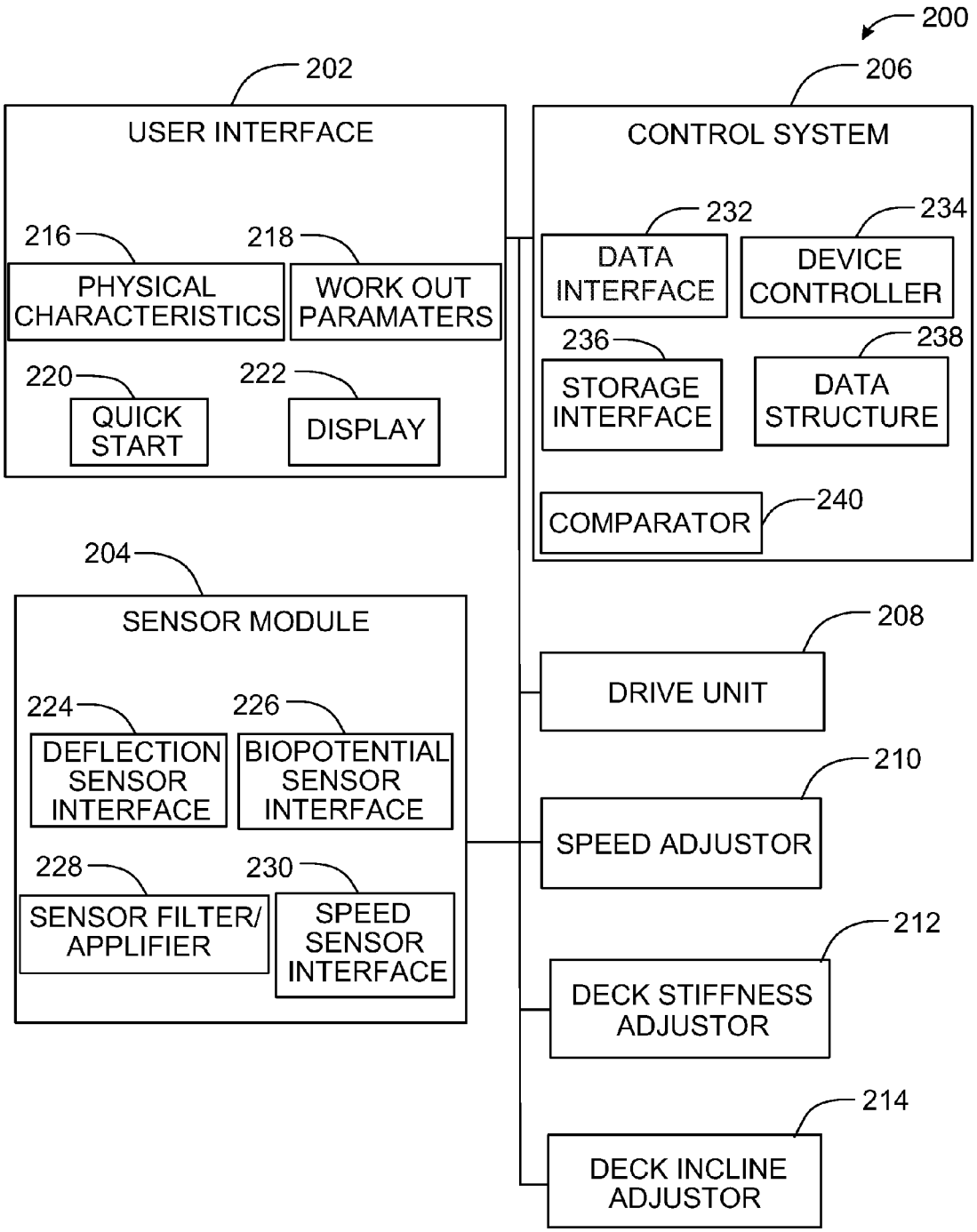
FIG. 2 illustrates a block diagram of an example apparatus that may be utilized to implement the example exercise machine of FIG. 1.

FIG. 2 illustrates is a block diagram of an example apparatus 200 that may be used to implement the treadmill 100 of FIG. 1. In particular, the example apparatus 200 may be used in connection with and/or may be used to implement the treadmill 100 of FIG. 1. For example, the example apparatus 200 may implement a process to adjust, for example, the stiffness of the deck 104, the speed of the belt 106, the incline angle of the deck, etc. The example apparatus 200 may also be configured to determine whether a user is walking or running and apply the proper metabolic expenditure equation when determining the caloric expenditure, the cadence of a user, the stride length of a user, the number of steps taken by a user, etc. Additionally or alternatively, the example apparatus 200 may be configured to provide feedback information to the user regarding the user's cadence, stride length, heart rate, etc., via, for example, a display.

The example apparatus 200 may be implemented using any desired combination of hardware, firmware, and/or software. For example, one or more integrated circuits, discrete semiconductor components, and/or passive electronic components may be used. While an example manner of implementing the control unit 118 of FIG. 1 will be described in connection with FIG. 4, one or more of the elements, processes, and/or devices illustrated in FIG. 2 may be combined, divided, re-arranged, omitted, eliminated, and/or implemented in any other way. Additionally or alternatively, some or all of the blocks of the example apparatus 200, or parts thereof, may be implemented using instructions, code, and/or other software and/or firmware, etc. stored on a machine accessible medium that, when executed by, for example, a processor system (e.g., a processor system 300 of FIG. 3) perform the operations represented in the flowcharts of FIGS. 4 through 13. Although the example apparatus 200 is described as having one of each block described below, the example apparatus 200 may be provided with two or more of any block described below. In addition, some blocks may be disabled, omitted, or combined with other blocks. When any of the appended claims are read to cover a purely software and/or firmware implementation, at least one of the example blocks of FIG. 2 are hereby expressly defined to include a tangible medium such as a memory, DVD, CD, etc. storing the software and/or firmware. Further still, the example apparatus 200 of FIG. 2 may include one or more elements, processes and/or devices in addition to, or instead of, those illustrated in FIG. 2, and/or may include more than one of any or all of the illustrated elements, processes and devices.

In the illustrated example of FIG. 2, the example apparatus 200 of FIG. 2 includes a user interface 202, a sensor module 204, a control system 206, a drive member 208, a speed adjustor 210, a deck stiffness adjustor 212, and a deck incline adjustor 214, all of which may be communicatively coupled as shown or in any other suitable manner.

The user interface 202 includes a user interface such as, for example, the user interface 120 of FIG. 1. The user input interface 202 may be implemented using a mechanical, and/or graphical (e.g., a touchscreen) user interface via which a user can input information. For example, the user interface 202 enables a user to input his or her physical characteristics 216 such as, for example, a user's height, weight, age, etc., and/or enables a user to input his or her desired workout parameters 218 such as, for example, the treadmill speed, the incline angle of the deck, the workout regimen, etc. Additionally, the user input interface 202 may allow a user to select one of a number of quick start workout regimens 220, which are based on predetermined workout parameters such as, belt speeds, deck incline angle, deck stiffness values, etc.

To communicate the feedback information to a user, the example user interface 202 may include a display interface 222. The display interface 222 may be, for example, the display 122 of FIG. 1. For example, the display interface 222 may provide heart rate values, the cadence of the user, the number of steps taken by the user, the stride length of the user, the deck stiffness values, the deck incline values, the speed values, a clock, a timer, etc. The display interface 222 may be communicatively coupled to the control system 206 to receive the feedback information.

The sensor module 204 provides feedback information to the control system 206, which processes the output signal communicated by an impact or deflection sensor interface 224. The deflection sensor interface 224 that provides a signal output based on the deflection of the deck 104. The output signal generated by the deflection sensor interface 224 correlates to a magnitude of a force imparted on the deck 104 by a user's feet during an exercise routine. The deflection sensor interface 224 may include a deck deflection sensor or measurement device such as, for example, the piezoelectric sensors 108 of FIG. 1, a footfall sensor, a pressure sensor, a sensor coupled to a force plate, etc., or any other suitable device that provides a signal in response to the deflection of the deck 104. The deflection sensor interface 224 may read (e.g., retrieve or receive) electrical signals (e.g., voltage signals) corresponding to the signals generated by the deflection of deck 104 caused by a user feet as they touch or impact the deck 104. The electrical signals are proportional to the force imparted to the deck 104 by the user's feet.

To measure the heart rate of a user when operating the treadmill 100 of FIG. 1, the sensor module 204 may include a biopotential sensor interface 226. The biopotential sensor interface 226 may include a biopotential sensor or measurement device such as, for example, the electrode sensors 128 of FIG. 1, or any other suitable device that provides a signal that responds to the user's heart beat. The biopotential sensor interface 226 may be communicatively coupled to the control system 206, which processes the output signal from the biopotential sensor interface 226. The biopotential sensor interface 226 may read (e.g., retrieve or receive) electrical signals corresponding to the biopotential signals generated by the user. The biopotential sensor interface 226 may then send the signals to the control system 206. Additionally or alternatively, the biopotential sensor interface 226 may communicate the signals to a sensor filter/amplifier 228.

The sensor filter/amplifier 228 may be configured to filter the signals of the deflection sensor interface 224 from the signals of the biopotential sensor interface 226. Additionally or alternatively, the sensor filter/amplifier 228 can be configured to amplify the output signals generated by the deflection sensor interface 224 and/or the biopotential sensor interface 226. Filtering the signals generated by the deflection sensor interface 224 from the signals generated by the biopotential sensor interface 226 can provide more accurate feedback information for determining the heart rate of the user.

To detect the speed of the belt 106, the sensor module includes a speed sensor interface 230. The speed sensor interface 230 may include a speed sensor or speed measurement device such as, for example, an encoder operatively coupled to the drive member 208 (e.g., a shaft of a motor). In other examples, the speed sensor interface 230 may be communicatively coupled to a current sensor or current measuring device and configured to obtain the electrical current draw values of, for example, the drive member 208 or motor. The speed sensor interface 230 may periodically read (e.g., retrieve or receive) signal measurement values from the speed sensor or current sensor. The speed sensor interface 230 may then send the measurement values to the control system 206. Additionally or alternatively, the speed sensor interface 230 may communicate the signal values to the speed adjustor 210.

To process the user's input information received via the user interface 202 and the signals generated by the sensor module 204, the example apparatus 200 includes the control system 206. The example control system 206 includes a data interface 232, a device controller 234, a storage interface 236, a data structure 238, and a comparator 240. Additionally or alternatively, although not shown, the control system 206 may also include other signal processing components such as, for example, analog to digital converts, filters (e.g., low-pass filters, high-pass filters, and digital filters), amplifiers, etc.

The data interface 232 includes an input configured to receive information from the user interface 202, the signals generated from the sensor module 204, the data structure 238, and/or the comparator 240. To communicate the feedback information, the data interface 232 includes an output interface configured to convey or communicate the feedback information to the device controller 234, the display 222, or any other output interface such as, for example, a display device (e.g., a liquid crystal display), a printer, an external storage device, or any other suitable network transmission or interface, etc.

The device controller 234 may be configured to receive information from the data interface 232 and/or the user interface 202. The device controller 234 communicates with the speed adjustor 210, the deck stiffness adjustor 212, and/or the deck incline adjustor 214. The device controller 234 may be configured to communicate with the speed adjustor 210 to adjust the speed of the drive member 208. For example, the device controller 234 causes the speed adjustor 210 to adjust the speed of the drive member 208 based on the speed values received by the data interface 232 or retrieved from the data structure 238 for a particular workout regimen selected by a user via the user interface 202.

The device controller 234 also communicates with the deck stiffness adjustor 212 to adjust the stiffness of the deck 104. For example, the data interface 232 may retrieve information from the data structure 238 that includes data corresponding to desired deck stiffness for a user's physical characteristics and workout regimen received by the data interface 232 via the user interface 202. In some examples, the control system 206 may communicate the information to the display 222 to recommend to a user a deck stiffness value. Also, the device controller 234 may communicate with the deck incline adjustor 214 to adjust the incline of the deck 104 based on the information received by the data interface 232 via the input interface 202 and/or the data structure 238. For example, the data interface 232 may receive an incline value for a particular workout regimen selected by a user via the user interface 202. The data structure 238 may include information such as, for example, predetermined workout parameters (e.g., speed, incline angle, etc.) for a given workout regimen that may be retrieved by the data interface 232, the comparator 240, and/or device controller 234.

Furthermore, the storage interface 236 may store the user's information or workout characteristics received via the user input interface 202. Additionally or alternatively, the storage interface 236 may store in memory the signal output values obtained during the user's workout from the deflection sensor interface 224, which can be used to profile a user's exercise session. The storage interface 236 may be configured to store data values in a memory such as, for example, the memory system 324, and/or the mass storage memory 325 of FIG. 3. Additionally, the storage interface 236 may be configured to retrieve data values from the data structure 238. For example, the storage interface 236 may access the data structure 238 to obtain speed values based on a quick start workout regimen 220 selected by a user and communicate the speed values to the speed adjustor 210. Additionally or alternatively, the storage interface 236 may access the data structure 238 to retrieve load-current correlation data corresponding to mechanical power outputs generated by the drive member 208 required to drive the belt 106 to determine when a user is operating the treadmill 100 and communicate the load-current values to the comparator 240.

The comparator 240 may be configured to perform comparisons based on values obtained from the user interface 202, the sensor module 204, the storage interface 236, and/or the data structure 238. For example, the comparator 240 may be configured to perform comparisons based on the signal output values received from the deflection sensor interface 224 and the deck stiffness entry value received from the user interface 202. The comparator 240 may then communicate the results of the comparisons to the deck stiffness adjustor 212. Although the example apparatus 200 is shown as having only one comparator 240, in other example implementations, a plurality of comparators may be used to implement the example apparatus 200.

To drive the belt 106 of the treadmill 100 of FIG. 1, the example apparatus 200 may be implemented with the drive member 208. The drive member 208 may be a motor such as, for example, an electric motor, or any other suitable drive member. The example drive member 208 may be implemented with pulleys or any other drive transmission(s) to drive the belt 106.

The speed adjustor 210 may be configured to adjust the speed of the drive member 208. The speed adjustor 210 may configured to receive speed values or settings from the user interface 202, the speed sensor interface 230, and/or the device controller 234 to set the speed of the drive member 208. For example, the data interface 232 may receive a signal measurement value from the speed sensor interface 230 and communicate the value to the device controller 234, which causes the speed adjustor 210 to adjust the speed of the drive member 208 and, thus, the speed of the belt 106.

To adjust the stiffness of the deck 104, the example apparatus 200 may be implemented with the deck stiffness adjustor 212. The deck stiffness adjustor 212 may be configured to adjust the stiffness of the deck 104 based on the deck stiffness values or settings from the user interface 202 and/or the control system 204. For example, the comparator 240 may retrieve predetermined deck stiffness values from the data structure 238 and determine the stiffness of the deck 104 based on the workout parameters 218 and the physical characteristics 216 received by the data interface 232 from the user interface 202. Additionally or alternatively, a user can manually select the stiffness of the deck 104 by entering a deck stiffness valve via the user interface 202. In some examples, the deck stiffness adjustor 212 may adjust the deck stiffness based on the comparison results obtained from the comparator 240. For example, if a comparison result obtained from the comparator 240 indicates that a deck deflect value obtained from the deflection sensor interface 224 does not correlate with respective deck deflection threshold valves retrieved from the data structure 238, then the deck stiffness adjustor 212 may increase or decrease the deck stiffness. The deck stiffness adjustor 212 may continue to adjust the stiffness of the deck 104 based on the deck deflection threshold measurement values retrieved from the data structure 238.

The deck incline adjustor 216 may be configured to adjust the incline of the deck 104. The deck incline adjustor 216 may be configured to obtain deck incline values or settings from the user input interface 202, the sensor module 204, and/or the control system 206 to set the incline angle of the deck 104. For example, a user can manually select the incline of the deck 104 by entering a deck incline valve via the user input interface 202. The device controller 236 receives the input information from the data interface 232 and causes the deck incline adjustor 214 to adjust the incline angle of the deck 104. Additionally or alternatively, the deck incline adjustor 214 may adjust the incline angle of the deck 104 based on the comparison results obtained from the comparator 240. For example, if a comparison result obtained from the comparator 240 indicates that a deck incline value does not correlate with a respective deck incline threshold valve retrieved from the data structure 238, then the deck incline adjustor 214 may increase or decrease the inclination of the deck. The deck incline adjustor 214 may continue to adjust the incline of the deck 104 based on the deck incline threshold measurement values retrieved from the data structure 238.

Additionally or alternatively, in some examples, the example apparatus 200 may be implemented with an energy saver or standby system. To provide a standby and wake-up system, the example apparatus 200 may be implemented with a backlight interface that is communicatively coupled to the device controller 236. The device controller 236 may be configured to receive information from the user input sensor interface 202 and/or the sensor module 204. For example, the data interface 232 may receive a magnitude measurement value from the deflection sensor interface 224 and retrieve predetermined threshold magnitude values from the data structure 238. The comparator 240 may compare the magnitude values and the predetermined threshold values to determine if the magnitude value is greater than the threshold value and communicate the results to device controller 236. The device controller 236 may cause the backlight interface to activate the treadmill 100 from standby status.

Figure 3:
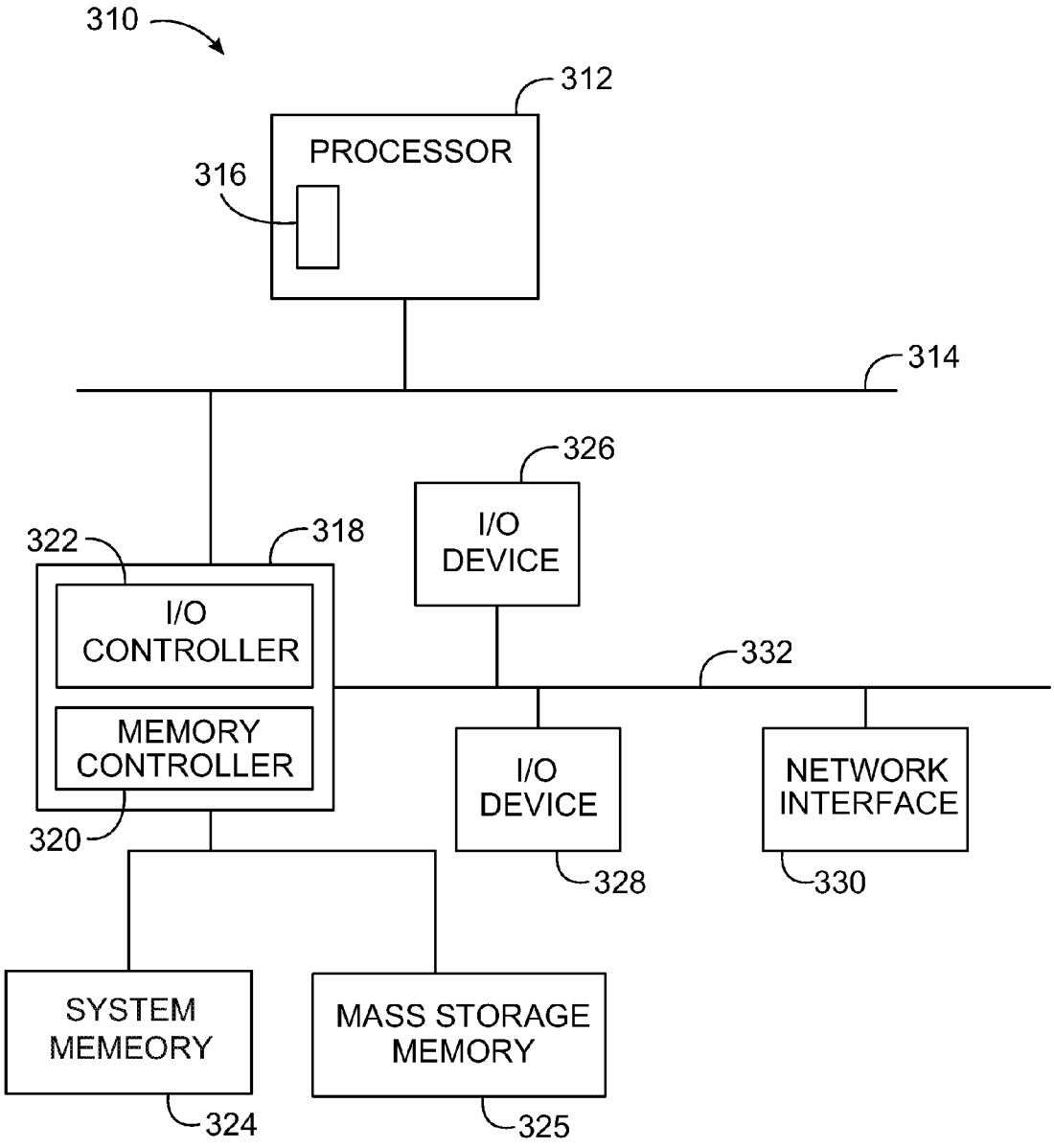
FIG. 3 is a block diagram of an example processor system that may be used to implement at least a portion of the example apparatus of FIG. 2.

FIG. 3 is a block diagram of an example processor system 310 that may be used to implement the example methods and apparatus described herein. As shown in FIG. 3, the processor system 310 includes a processor 312 that is coupled to an interconnection bus 314. The processor 312 includes a register set or register space 316, which is depicted in FIG. 3 as being entirely on-chip, but which could alternatively be located entirely or partially off-chip and directly coupled to the processor 312 via dedicated electrical connections and/or via the interconnection bus 314. The processor 312 may be any suitable processor, processing unit or microprocessor. Although not shown in FIG. 3, the system 310 may be a multi-processor system and, thus, may include one or more additional processors that are identical or similar to the processor 312 and that are communicatively coupled to the interconnection bus 314.

The processor 312 of FIG. 3 is coupled to a chipset 318, which includes a memory controller 320 and an input/output (I/O) controller 322. As is well known, a chipset typically provides I/O and memory management functions as well as a plurality of general purpose and/or special purpose registers, timers, etc. that are accessible or used by one or more processors coupled to the chipset 318. The memory controller 320 performs functions that enable the processor 312 (or processors if there are multiple processors) to access a system memory 324 and a mass storage memory 325.

The system memory 324 may include any desired type of volatile and/or non-volatile memory such as, for example, static random access memory (SRAM), dynamic random access memory (DRAM), flash memory, read-only memory (ROM), etc. The mass storage memory 325 may include any desired type of mass storage device including hard disk drives, optical drives, tape storage devices, etc.

The I/O controller 322 performs functions that enable the processor 312 to communicate with peripheral input/output (I/O) devices 326 and 328 and a network interface 330 via an I/O bus 332. The I/O devices 326 and 328 may be any desired type of I/O device such as, for example, a keyboard, a video display or monitor, a mouse, etc. The network interface 330 may be, for example, an Ethernet device, an asynchronous transfer mode (ATM) device, an 802.11 device, a DSL modem, a cable modem, a cellular modem, etc. that enables the processor system 310 to communicate with another processor system.

While the memory controller 320 and the I/O controller 322 are depicted in FIG. 3 as separate functional blocks within the chipset 318, the functions performed by these blocks may be integrated within a single semiconductor circuit or may be implemented using two or more separate integrated circuits.

The example processes of FIGS. 4-13 may be performed using a processor, a controller, and/or any other suitable processing device. For example, the example processes of FIGS. 4-13 may be implemented in coded instructions stored on a tangible medium such as a flash memory, a read-only memory (ROM) and/or random-access memory (RAM) associated with a processor (e.g., the example processor 312 discussed below in connection with FIG. 3). Alternatively, some or all of the example processes of FIGS. 4-13 may be implemented using any combination(s) of application specific integrated circuit(s) (ASIC(s)), programmable logic device(s) (PLD(s)), field programmable logic device(s) (FPLD(s)), discrete logic, hardware, firmware, etc. Also, some or all of the example processes of FIGS. 4-13 may be implemented manually or as any combination(s) of any of the foregoing techniques, for example, any combination of firmware, software, discrete logic, and/or hardware. Further, although the example processes of FIGS. 4-13 are described with reference to the flow diagrams of FIGS. 4-13, other methods of implementing the processes of FIGS. 4-13 may be employed. For example, the order of execution of the blocks may be changed, and/or some of the blocks described may be changed, eliminated, subdivided, or combined. Additionally, any or all of the example processes of FIGS. 4-13 may be performed sequentially and/or in parallel by, for example, separate processing threads, processors, devices, discrete logic, circuits, etc.

Figure 4:
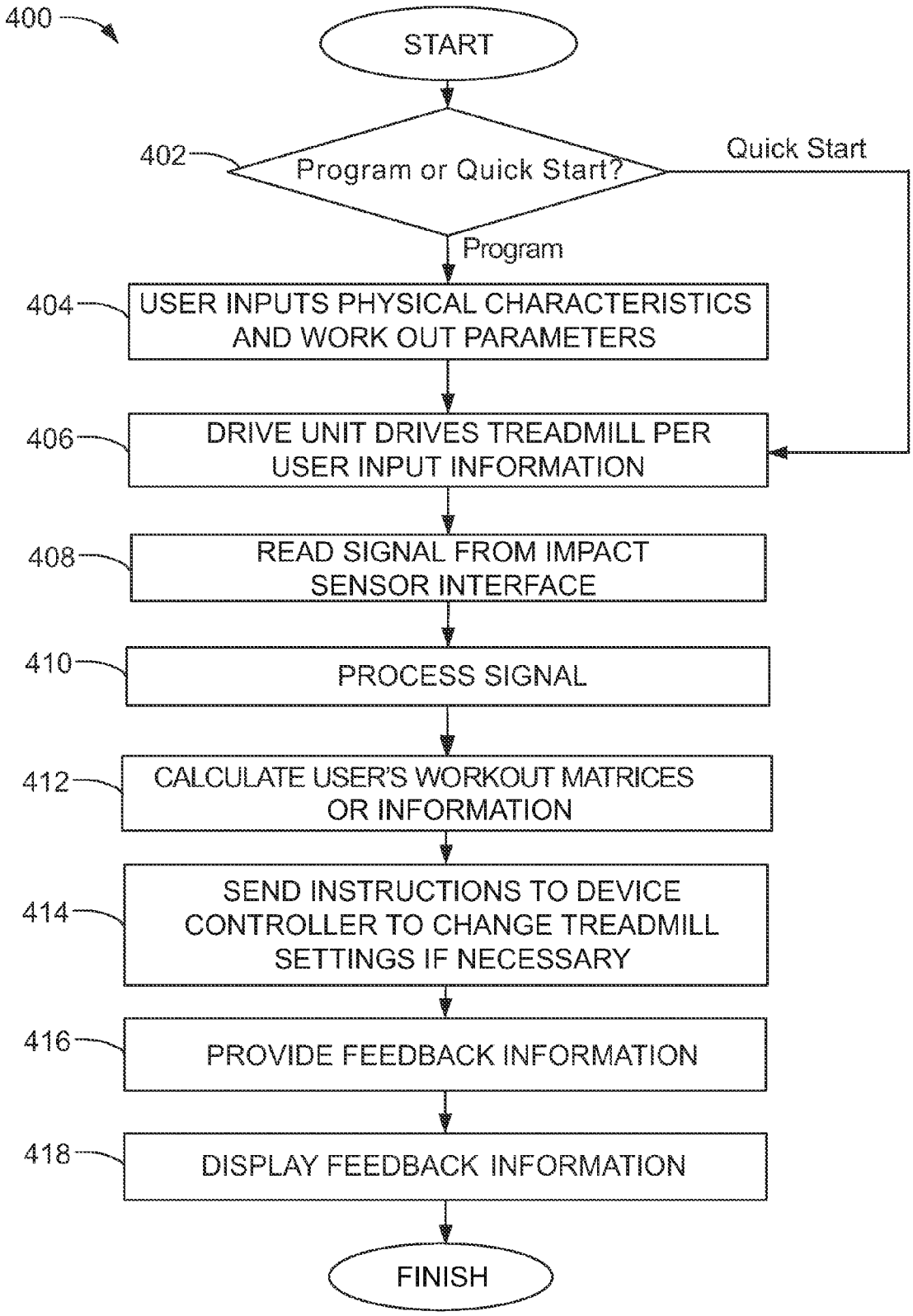
FIG. 4 is a flow diagram illustrating an example operation of the example apparatus of FIG. 2.

FIG. 4 is a flow diagram illustrating an example operation of the example apparatus 200 of the treadmill 100. In operation, a user may either manually select a program or, alternatively, select a predetermined quick start workout program via the user interface 202 (block 402). If program is selected, a user may manually input his or her physical characteristics and workout parameters (block 404) via the user interface 202. For example, a user may input his or her weight, height, walking/running speed, incline, training routine, deck stiffness, etc., to the example user input interface 120 of FIG. 1. If quick start is selected, then the user may only be required to input his or her physical characteristics and the workout parameters are retrieved from the data structure 238 for the particular exercise regimen selected by the user.

When the input information has been entered, the control system 206 receives the information and drives the treadmill 100 per the user input information received from the user interface 202 (block 406). For example, the control system 206 processes the information received from the user input interface 202 and directs the device controller 234 to cause the speed adjustor 210 to adjust the speed of the drive member 208, to cause the deck stiffness adjustor 212 to adjust the stiffness of the deck 104, and/or may cause the deck incline adjustor 214 to adjust the incline angle of the deck 104. The control system 206 may store one or more training routines in memory via, for example, the storage interface 236 and/or may include an input/output (I/O) port to send/receive training routines from various sources including, but not limited to, a network connected to a computer, a computer operated by a personal trainer, and/or the Internet. The I/O port may send/receive training routines and/or user information, such as user age, weight, body mass, etc., via a wired and/or wireless interface. Additionally or alternatively, the control system 206 may store in memory the user input information received from the user interface 202 via the storage interface 236.

During the exercise routine, the impact of the user's feet on the example deck 104 causes the deflection sensor interface 224 to provide or generate an electrical output signal that is read by the data interface 232 of the control system 204 (block 408). The deflection sensor interface 224 generates an electrical output signal for each user's right and left foot that impacts or deflects the deck 104 as the user walks, jogs, or runs on the deck 104. The signal output from the deflection sensor interface 224 is processed by the control system 206 (block 410). The control system 206 uses the signal output values to determine various workout matrices and information (block 412). For example, the processed output signals may be used to determine, for example, a cadence of a user, a stride length of a user, the number of steps taken by a user, the caloric expenditure equation, and/or other characteristics, etc. An example process diagram of the example control system 206 is discussed in connection with FIG. 5.

The control system 206 calculates the user's workout matrices or information (block 412) such as, for example, the user's cadence, heart rate, stride length, etc., based on the information received by the user interface 202, the sensor module 204, the storage interface 236 and/or the data structure 238. This information may be processed by the device controller 234 and may be utilized to automatically control or change the settings of the treadmill 100, if necessary (block 414). For example, the comparator 240 may compare the information processed by the control system 206 with the data retrieved from the data structure 238 for a given training routine selected by the user and automatically adjust the operating parameters (e.g., speed, incline angle, deck stiffness, etc.) of the treadmill 100 during the user's workout to reflect the parameters of the selected training routine stored in the storage interface 236. Additionally or alternatively, the user's workout matrices or information from block 414 may be stored in memory via the storage interface 236 to establish average or optimum user workout matrices tailored to the user. The average or optimum workout matrices may be stored as a data structure and retrieved by the data interface 232, the device controller 234, and/or the comparator 240.

Furthermore, the processed information may be used to provide feedback information to the user, and/or may provide training information so that a user can adjust, for example, the user's stride length, cadence, etc. (block 416). Additionally or alternatively, the processed information may be used to provide feedback information to a user via the display 222 (block 418). The feedback information may be, for example, feedback information relating to proper cadence (e.g., a cadence coach), proper stride length for a particular exercise, number of steps taken, caloric expenditure expended during an exercise session, etc.

Figure 5:
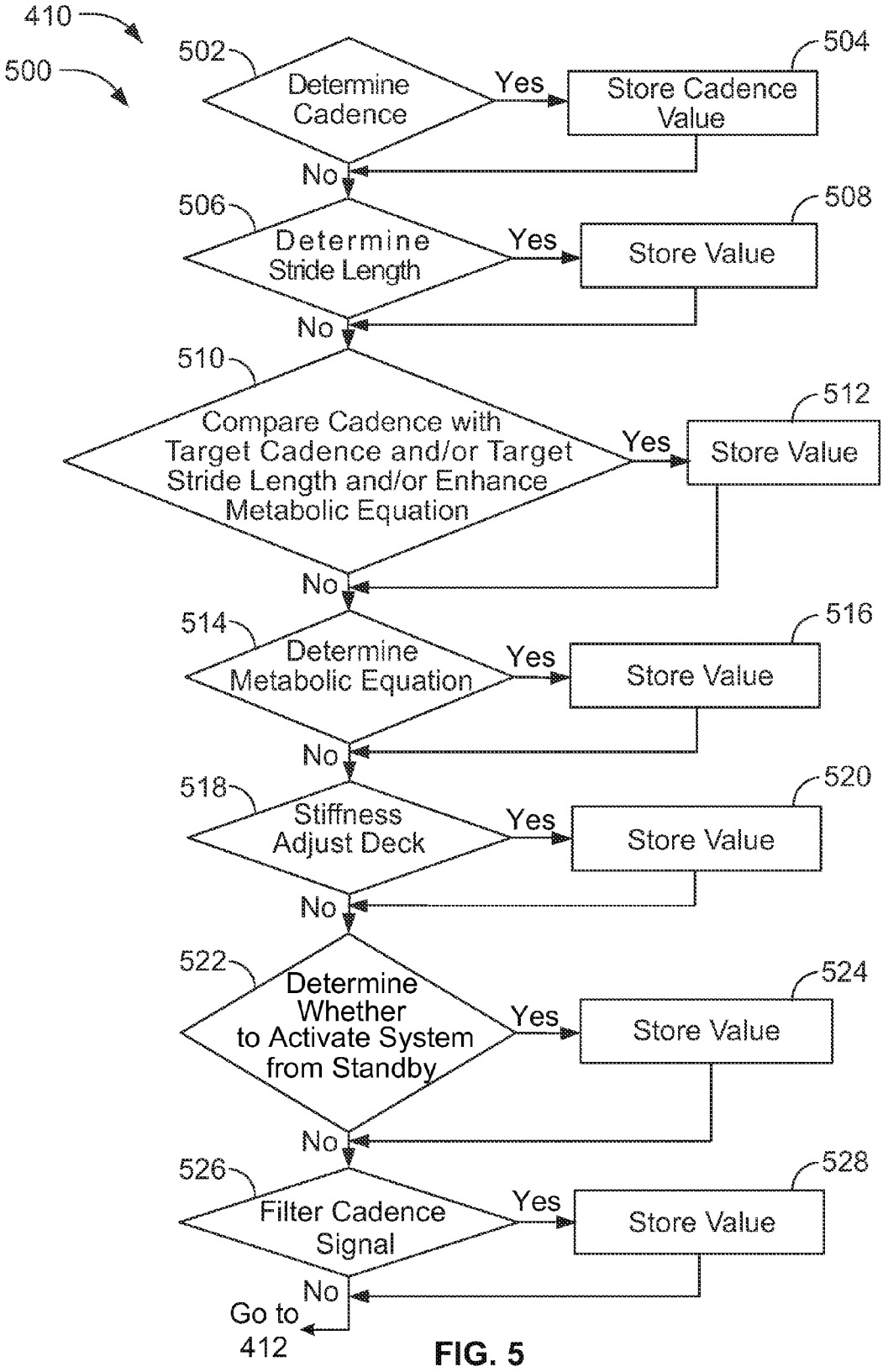
FIG. 5 is an example flowchart representing processing the signal output from the example operation of FIG. 4.

FIG. 5 is an example flowchart representing an example process to implement block 410 of FIG. 4. The order of the flowchart is provided for illustration purposes and one or more of the processes illustrated in FIG. 5 may be combined, divided, re-arranged, omitted, eliminated, and/or implemented in any other way.

To determine a user's cadence, the example control system 206 may process the output signal generated by the deflection sensor interface 224 (e.g., the piezoelectric sensors 108) to determine the user's cadence (block 502). The cadence value can be stored in memory via the storage interface 236 (block 504). A detailed description of this determination is described in greater detail below in connection with FIG. 6.

The example control system 206 may process the output signal generated by the deflection sensor interface 224 to determine the user's stride length (block 506). The stride length value can be stored in memory via the storage interface 236 (block 508). A detailed description of this determination is described in greater detail in connection with FIG. 7.

The control system 206 may process the signal output of the deflection sensor interface 224 to determine if the user's cadence is similar to a target cadence (block 510). The comparator 240 compares the cadence from block 502 with a target cadence stored in memory in the storage interface 236 or cadence data structure 238. The cadence and the target cadence comparison values can be stored in memory via the storage interface 234 (block 512). Additionally or alternatively, the control system 206 may process the signal output of the deflection sensor interface 224 to provide feedback information via the display 222 to the user so that the user can determine if the user's stride length is similar to a target stride length (block 510). The stride length and the target stride length comparison values can be stored in memory via the storage interface 236 (block 512). An example process to determine if a user's cadence is similar to a target cadence and/or a target stride length is described in greater detail below in connection with FIG. 8. Furthermore, additionally or alternatively, the control system 206 may process the signal to enhance or adjust the metabolic cost calculation by multiplying the metabolic cost calculation by a coefficient value (block 512). An example process to determine if a user's cadence is similar to a target cadence and/or a target stride length is described in greater detail below in connection with FIG. 8.

To determine the proper ACSM metabolic equation, the control system 206 may process the signal output from the deflection sensor interface 224 to determine whether the user is walking or running (block 514). The metabolic expenditure equation can be stored in memory via the storage interface 236 (block 516). An example process to determine the proper metabolic expenditure equation is described in greater detail below in connection with FIGS. 9 and 10.

The control system 206 may process the signal output of the deflection sensor interface 224 to determine whether to adjust the deck stiffness based on the information received by the user interface 202 and/or the sensor module 204 (block 518). The deck stiffness value can be stored in memory via the storage interface 236 (block 520). An example process to determine whether to adjust the deck stiffness is described in greater detail below in connection with FIG. 11.

The control system 206 may process the signal output of the deflection sensor interface 224 to determine whether a user is present on the treadmill 100 and, thus, determine whether to activate the treadmill 100 from standby status (block 522). The control system 206 may store the processed value in memory via the storage interface 236 (block 524). An example process to determine whether to activate the treadmill 100 from standby status is described in greater detail below in connection with FIG. 12.

The signal output of the deflection sensor interface 224 may be filtered from the signal output of the biopotential sensor interface 226 (block 526) to increase the accuracy of the biopotential sensor interface 226. The processed value can be stored in memory via the storage interface 236 (block 528). An example process to filter the signal output from the deflection sensor interface 224 from the signal output of the biopotential sensor interface 226 is described in greater detail below in connection with FIG. 13.

Figure 6:
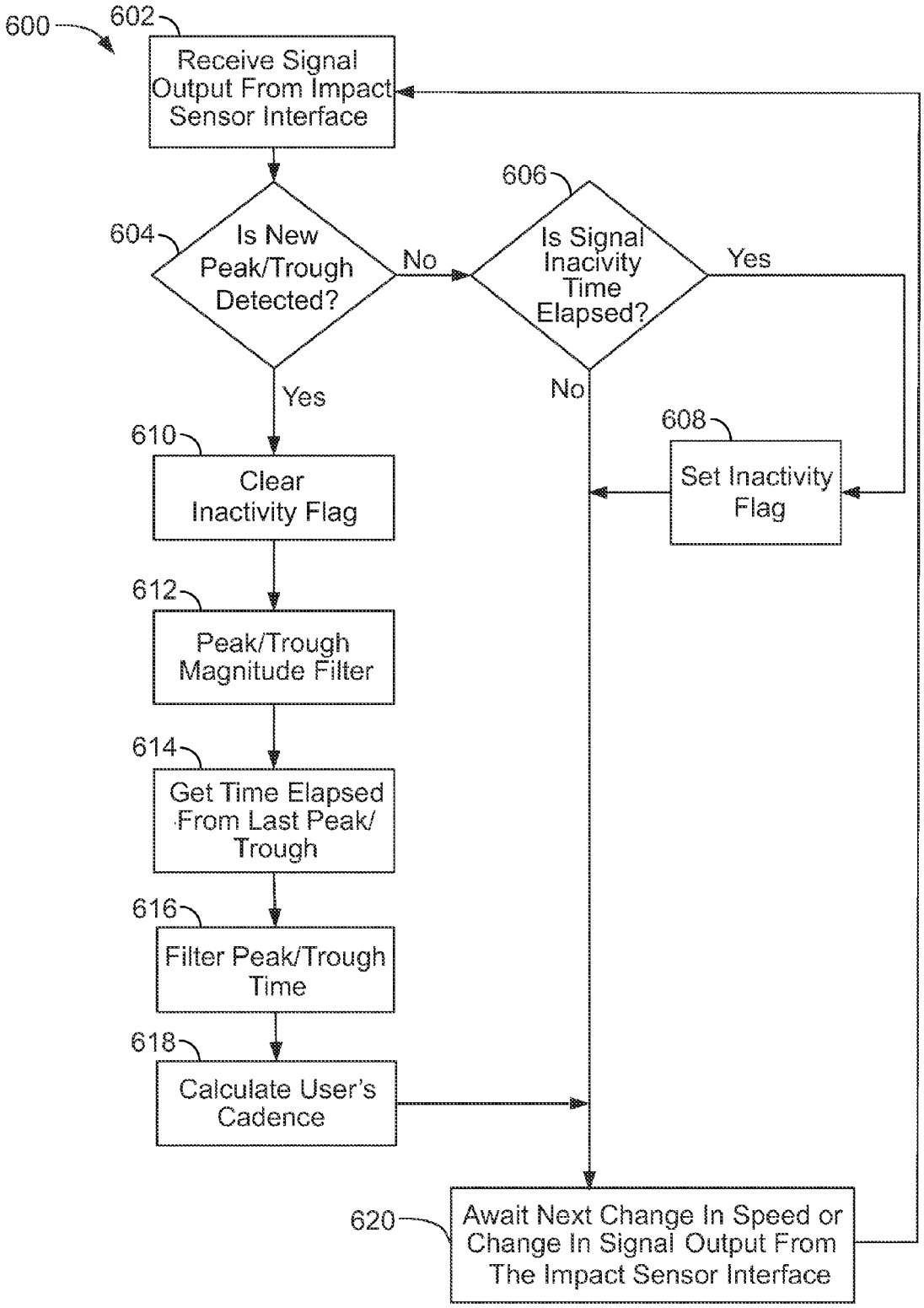
FIG. 6 illustrates an example flow diagram depicting an example process to determine a cadence of a user.

FIG. 6 illustrates an example flow diagram depicting an example process 600 to determine cadence of a user. As noted above, the piezoelectric sensors 108 generate an electrical output signal that is processed by the control system 206 to determine a user's cadence. Each of the electrical signals generated by the deflection sensor interface 224 correlates to a user's right foot or left foot impacting the deck 104 during the workout regimen. The output signals can be used to determine cadence by counting footstrikes of a user within a given period of time or, alternatively, can count a time interval between consecutive footstrikes. For example, FIGS. 14A-14D provide graphical illustrations of the electrical signal outputs generated per a time interval of a user's feet impacting the deck 104 when exercising on the treadmill 100 at speeds ranging from 2.0 MPH, 3.0 MPH, 6.0 MPH, and 8.0 MPH, respectively. Referring to FIGS. 14A-14D, the period of time a user's foot impacts the deck 104 is illustrated between the peaks and troughs 1402-1416 of the graphical output. For example, the vertical lines 1418 and 1420 illustrate the time period a user's left foot impacted the deck 104 or caused the deck 104 to deflect. Thus, the control system 206 may process the signal output generated by the deflection sensor interface 224 to determine cadence by determining the time interval between consecutive footstrikes (i.e., signal outputs). The graphical illustrations indicate that the time interval between impacts on the deck 104 decreases as the user runs on the deck 104.

To determine cadence, the control system 206 receives the signal output generated by the deflection sensor interface 224 such as, for example, an electrical signal correlating to the deflection of the deck 104 caused by a user's foot impacting the deck 104 (block 602). The control system 206 processes the signal received from the deflection sensor interface 224 and determines whether a new peak or trough is detected (block 604) such as, for example, the peaks and troughs 1402-1416 from the example signal outputs of FIGS. 14A-14D. If a new peak or trough is not detected, the control system 206 determines whether a predetermined time period of inactivity has elapsed since the previous input or signal generated by the deflection sensor interface 224 (block 606). The predetermined time period of inactivity can be set to indicate that no input or signal has been received during a period of time in which the deflection sensor interface 224 would be expected to provide when a user is operating the treadmill 100. The control system 206 may include an inactivity flag that is set if such a time period of inactivity is detected (block 608). If a new peak or a trough is detected, then the inactivity flag is cleared (block 610). The output signals from the deflection sensor interface 224 are filtered to obtain the magnitude peak and trough values (block 612).

After the magnitude peak and trough values have been detected, the control system 206 determines the time that has elapsed between a first peak or trough and a second peak or trough (block 614). The control system 206 can retrieve the time interval from a timer. The time values are filtered to obtain time interval between the magnitude peak or trough values determined from block 612 (block 616). The cadence of a user is determined by calculating the time interval between consecutive impacts or footstrikes (block 618). Once the cadence is determined or, if the signal inactivity time has not elapsed (block 606), then processor 204 awaits the next change in the speed or the signal output from the deflection sensor interface 224 (block 620).

Figure 7:
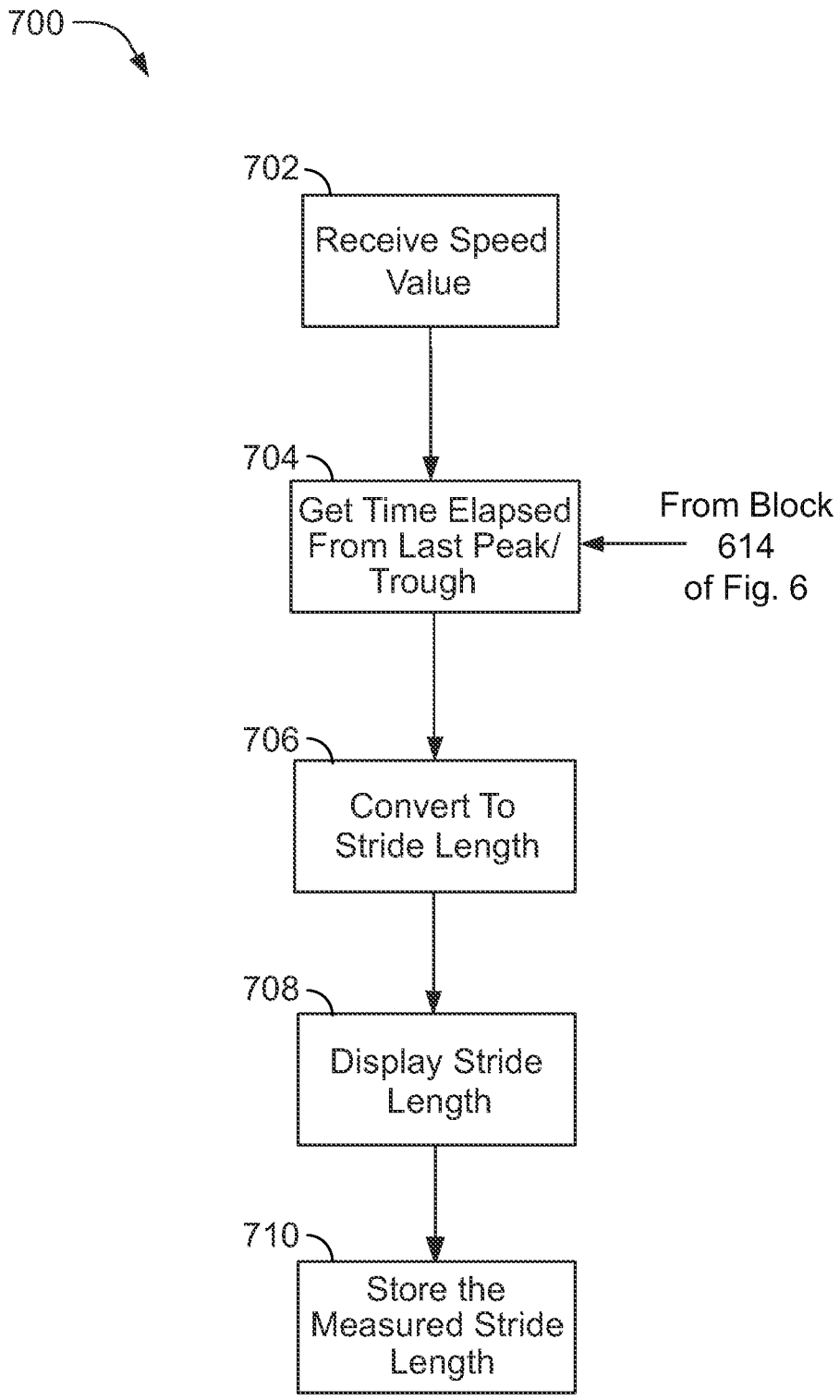
FIG. 7 illustrates an example flow diagram depicting an example process to determine a stride length of a user.

FIG. 7 illustrates an example flow diagram depicting an example process 700 to determine the user's stride length. To determine the stride length, the control system 206 receives the speed value (block 702). The speed value can be received from the user input interface 202 and/or the speed sensor interface 230. The data interface 232 receives the belt speed value and monitors the belt speed of the treadmill 100 during the user's workout by sampling the speed sensor interface 230, for example, every four milliseconds. The control system 206 also measures the time interval between impacts of the user's feet on the deck 104 (block 704). As described above in connection with block 614 of FIG. 6, the time interval between impacts of the user's feet on the deck 104 can be provided from the peaks and/or troughs of the signals generated by the deflection sensor interface 224. Thus, the time interval between impacts of the user's feet on the deck 104 can be provided from the process represented in block 614 of FIG. 6. The control system 206 calculates the stride length by multiplying the time between foot fall impacts by the speed of the belt 106 (block 706). The stride length calculation determined in block 706 may be displayed to the user via for example, the display interface 222 (block 708). Additionally or alternatively, the control system 206 may store in memory the calculated stride length for the user at the selected belt speed (block 710). The stored stride length value may be used as a nominal or average stride length of the user.

Figure 8:
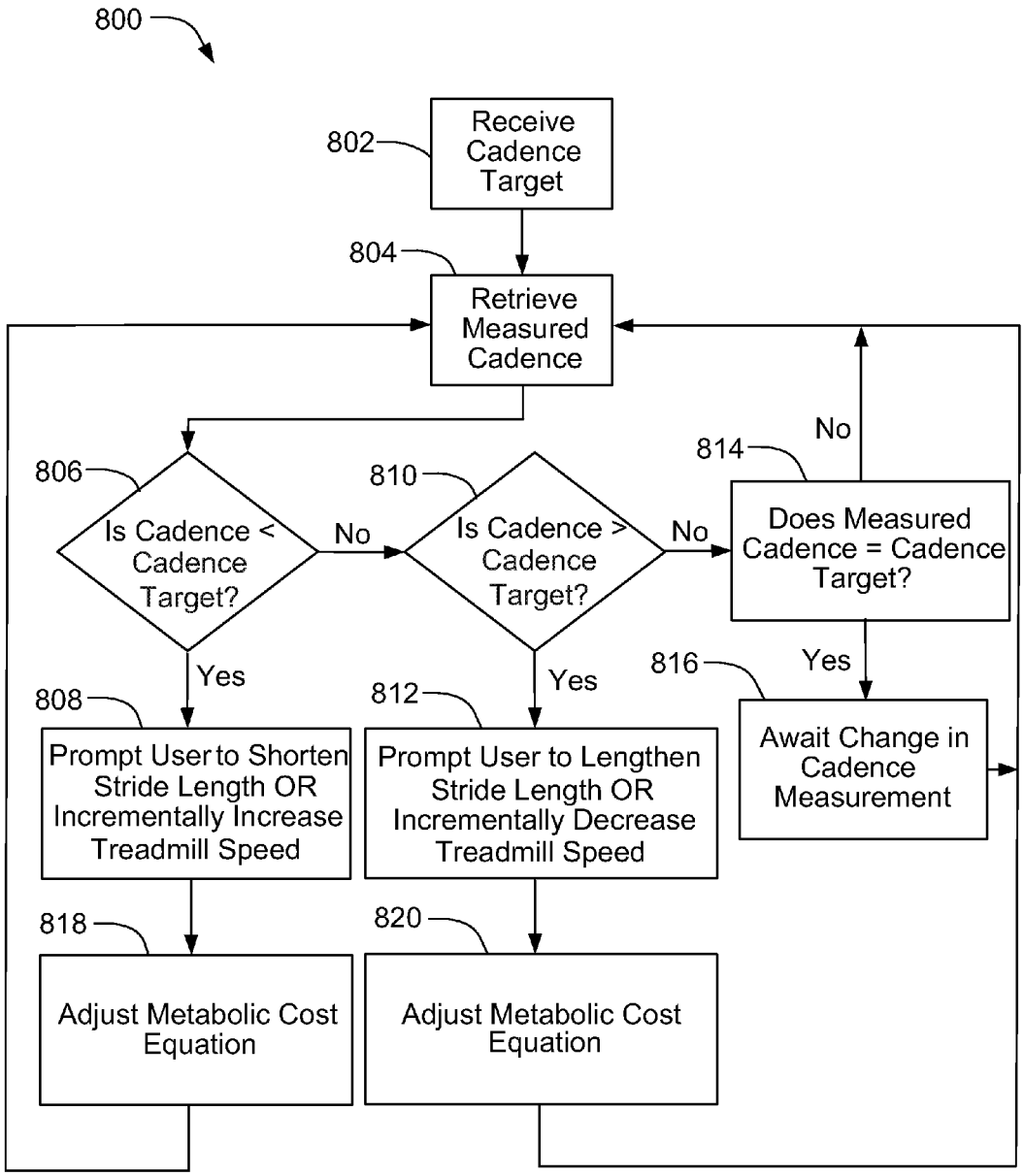
FIG. 8 illustrates an example flow diagram depicting an example process to provide feedback information relating to cadence and stride length to a user during an exercise session.

FIG. 8 illustrates an example flow diagram depicting an example process 800 to provide feedback information to a user to train or coach the user during a workout regimen. A cadence coach can encourage a user to train for interval training at a constant speed, encourage a user to take longer, or shorter stride lengths during a specific exercise regimen, and/or suggest an optimal stride length.

The control system 206 receives the user's desired cadence target from the user interface 202 (block 802). Alternatively, the user may select a workout regimen to train for a desired target cadence and the control system 206 can retrieve the target cadence from the data structure 238 for the specified workout regimen (block 802). For example, during a workout setup, a user may select cadence coach or stride length coach from the user interface 202 that may prompt a user to input the type of training the user desires such as, for example, the desired speed, endurance, distance, and/or caloric goal, etc. The control system 206 may retrieve the target cadence for the selected workout regimen from the data structure 238. The data structure 238 may include look-up tables developed from research, surveys, studies, etc., based on the physical characteristics 216 of the user received from the input interface 202. Additionally or alternatively, the data structure 238 may include look-up tables with recommended stride lengths derived from research, surveys, studies, based on the physical characteristics 216 (e.g., height, inseam, fitness lever, etc.), or other data.

During the workout, the control system 206 retrieves or calculates the measured cadence (block 804). The measured cadence can be retrieved or provided from the process represented in block 618 of FIG. 6. The comparator 240 then compares the measured cadence from block 618 with the target cadence selected by the user via the user interface 202 or the data structure 238.

The control system 206 determines whether the measured cadence is less than the target cadence (block 806). If the measured cadence from block 618 is less than the target cadence received from the user interface 202 or the data structure 238, then the control system 206 prompts the user via, for example, the display 222 to shorten the user's stride length or, alternatively, to incrementally increase the belt speed (block 808). Alternatively, the control system 206 may direct the device controller 234 to incrementally increase the belt speed automatically so that the user does not have to manually adjust the speed of the belt 106.

If the measured cadence is not less than the target cadence, then the control system 206 determines whether the measured cadence is greater than the target cadence (block 810).

If the measured cadence from block 618 is greater than the target cadence received from the user interface 202 or stored in the data structure 238, then the control system 206 prompts the user via, for example, the display 222 to lengthen the user's stride length or, alternatively, to incrementally decrease the belt speed (block 812). Alternatively, the control system 206 may direct the device controller 234 to incrementally decrease the belt speed automatically so that the user does not have to manually adjust the speed of the belt 106. If the measured cadence is not greater than the target cadence, then the control system determines if the measured cadence is equal to the target cadence (block 814). If the measured cadence is equal to the target cadence, then the control system 206 awaits change in the measured cadence (block 816) from, for example, block 614 or the user interface 202. If the measured cadence is not equal to the target cadence, then the control returns to block 804.

Additionally or alternatively, when the user shortens or lengthens his stride length, the control system 206 may adjust the metabolic cost equation when calculate the caloric expenditure of the user during the exercise session (block 818 or block 820). Control returns to block 804.

Intentionally causing a user to shorten or lengthen their stride to deviate from their normal or nominal stride length and to an average stride may result in an increase in caloric burn or expenditure. For example, a user that intentionally walks or runs with an abnormally long gait so as to change his stride length to 120 percent of their nominal stride length for a given speed and workout regimen can double their metabolic cost during the exercise session. Thus, it is advantageous to determine a user's nominal stride length and compare the nominal stride length with an average stride length and, altering the user's nominal stride length to expend a greater amount of calories.

To adjust the metabolic cost equation, the control system 206 retrieves a coefficient value from the data structure 238 having look-up tables and multiplies the metabolic cost equation with the coefficient value. To retrieve the proper coefficient value, the control system determines a delta value and the speed value of the treadmill. The delta value is obtained by determining the difference between the user's nominal stride length and an average stride length retrieved from the data structure 238 having optimum stride length look-up tables. The average stride length values are predetermined stride length values that represent an optimum exercise session based on the user's physical characteristics and workout parameters such as, for example, the speed of the treadmill.

As described above in connection with FIG. 7, the cadence may also be used to determine the stride length of the user. For example, the stride length of the user can be measured by multiplying the cadence of the user by the speed value of the belt received by the control system 206 from the user interface 202 or the speed sensor interface 226. In addition, a user's nominal stride length can be determined by storing the measured or calculated stride length values in the storage interface 236 and calculating an average stride length, which approximates the nominal stride length of the user. The nominal stride length of the user may be determined prior to the control system 206 prompting the user to alter their stride length. In some examples, a user's nominal stride length may be chosen from any number of predetermined average standards.

Additionally or alternatively, the example feedback information provided by the example process 800 may be provided as a graphical representation via the display 222. For example, the display may show an image of a person to represent the user. The graphical illustrations may display the person having the same cadence as the user and may serve, for example, as a motivational tool, explain the biomechanics of the walking or running gait in real time and synchronized with the user's gait, show graphics of which muscle groups are active during each stance phase as a real-time educational tool, etc.

Figure 9:
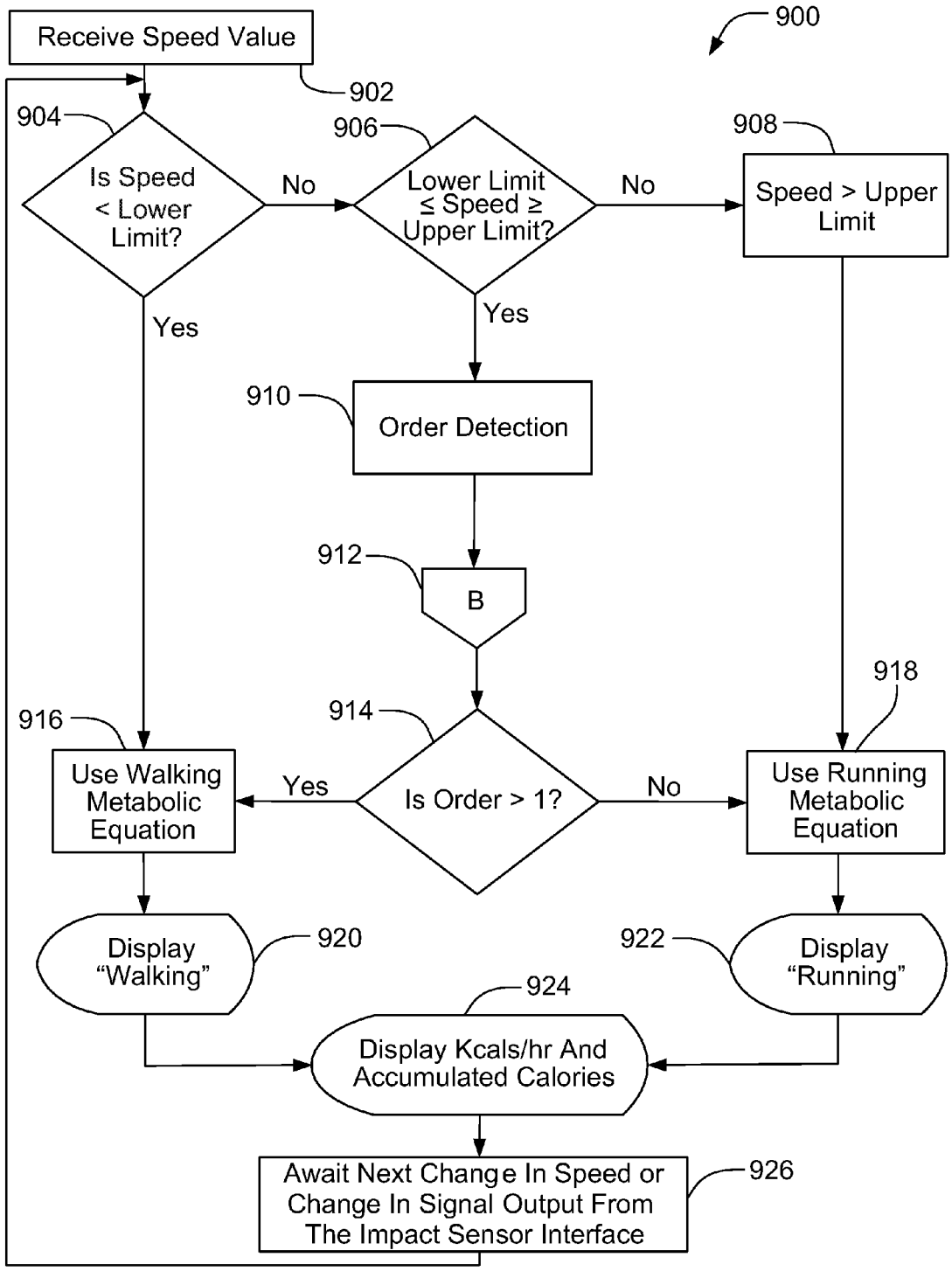
FIG. 9 illustrates an example flow diagram depicting an example process to determine the metabolic expenditure equation.

FIG. 9 illustrates an example flow diagram depicting an example process 900 to determine whether a user is running or walking and apply the proper metabolic expenditure equation to calculate the user's caloric expenditure during an exercise session. In the example, the control system 206 receives the speed value from the input interface 202 and/or the speed sensor interface 230 (block 902). The control system 206 determines whether the speed value is less than a threshold lower limit (block 904). The example threshold lower limit may include speeds less than, for example, 3.5 miles per hour (mph). If the speed is greater than or equal to the lower limit threshold value, then the control system 206 determines if the speed is less than or equal to an upper limit threshold value (block 906). An example threshold upper limit value may include speeds greater than 5.5 mph. If the speed value is greater than the upper limit threshold value, then the control system 206 determines that the speed is greater than the upper limit threshold value (block 908).

If the speed value is greater than or equal to the lower limit threshold value, and the speed value is less than or equal to the upper limit threshold value, then the control system 206 determines an order detection (block 910) represented by an example process 912 and described in connection with FIG. 10 below. The order detection determines an order value of the output signals to determine whether the user is running or walking on the treadmill. If the order detection is greater than the value 1 (block 914) or the speed value is less than the lower limit threshold value (block 904), then the control system 206 is to use the walking metabolic cost equation when determining the user's caloric expenditure during the exercise session (block 916). If the order is not greater than the value 1 (block 914) or the speed value is greater than the upper limit threshold value (block 908), then the control system 206 is to use the running metabolic cost equation when determining the user's caloric expenditure during the exercise session (block 918).

If the walking metabolic cost equation is selected, then the example control system 206 may display the word "walking" to the user via, for example, the display 222 (block 920). If the running metabolic cost equation is selected, then the example control system 206 may display the word "running" to the user via, for example, the display 222 (block 922). The example control system 206 may also provide that includes the amount of calories expended per hour (e.g., Kcals/hr) and/or a total amount of accumulated calories expended during the exercise session (block 924). The control awaits the next change in speed provided by the speed sensor interface 230 and/or a change in the signal output generated by the deflection sensor interface 224 (block 926).

Figure 10:
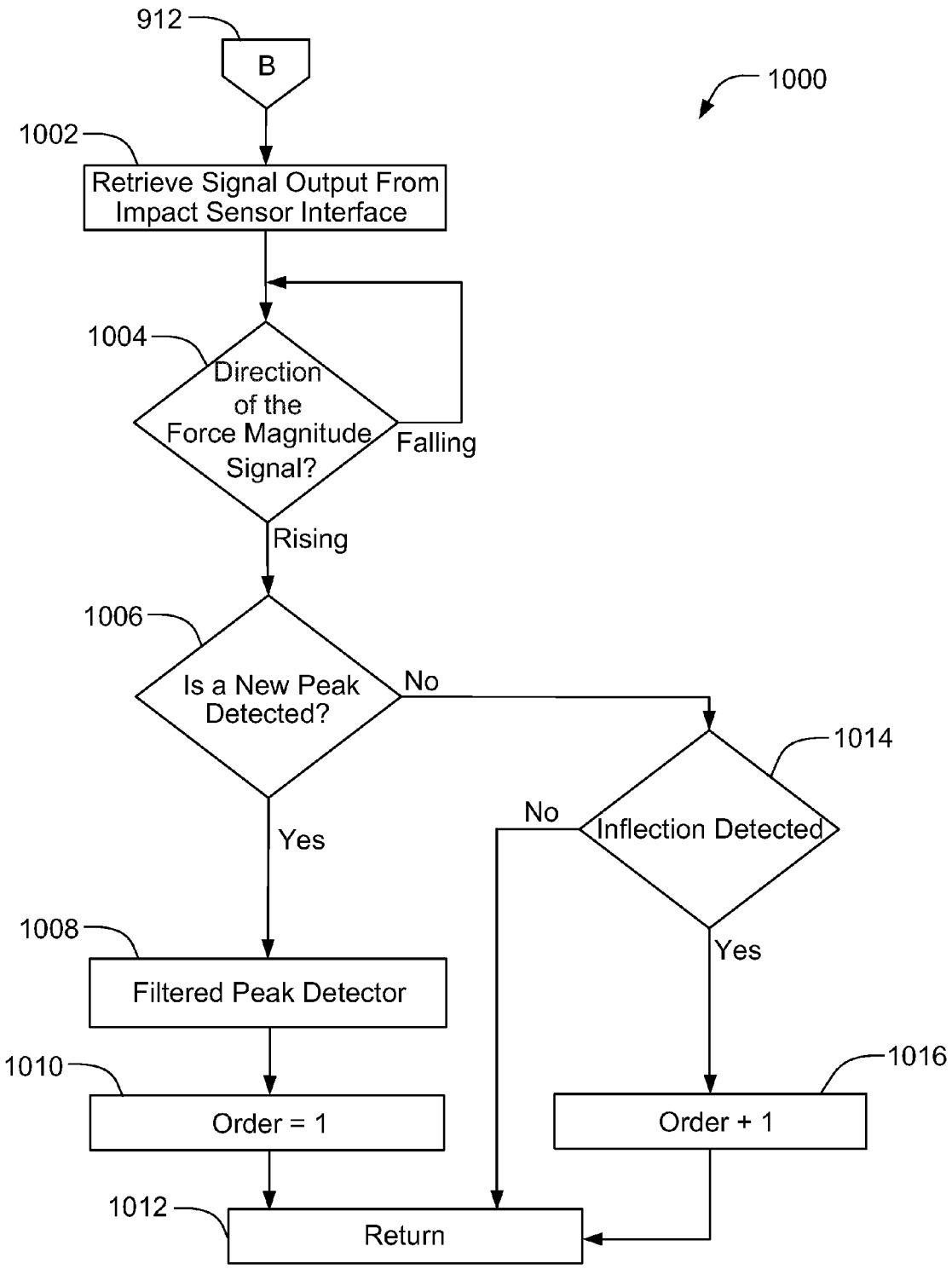
FIG. 10 illustrates an example flow diagram depicting an example process to implement the example process of FIG. 9.

FIG. 10 illustrates an example flow diagram depicting an example process 1000 to implement the example order detection process 910 of FIG. 9. The order detection process 910 analyzes the waveforms of the output signals of the deflection sensor interface 224 to detect whether an inflection point in the output signals is occurring at a peak or trough value of the output signal, or whether an inflection point in the output signal is occurring between a peak or trough value. An inflection point is a change in direction of the waveform of the output signal (e.g., a change in the direction of the slope of a curve representing the waveform output signal). An example inflection point 1417 (e.g., a positive slope curve to a negative slope curve) occurring between the peak 1402 and the trough 1404 values of an example output signal is illustrated in FIG. 14A. Referring to FIGS. 14A and 14B, when a user is walking on the treadmill 100, the deflection sensor interface 224 typically generates output signals having inflection points between the peak or trough 1402, 1406, 1404 and 1408 values, respectively (i.e., having inflection points on the waveform curve other than the inflection points at the peak and trough values). In contrast, referring to FIGS. 14C and 14D, when a user is running on the example treadmill 100, the deflection sensor interface 224 typically generates output signals that do not have inflection points between the peak or trough values 1410, 1414, 1412 and 1416 respectively (i.e., the inflection points occur at the peak or trough values between footfall impacts).

To detect the order, the example control system 206 receives or retrieves the signal output generated by the deflection sensor interface 224 (block 1002). The control system 206 determines the direction of the signal output from the deflection sensor interface 224 (block 1004). If the direction of the magnitude of the output signal has a negative slope or is falling, then the control system 206 awaits the next change in the direction of the output signal from the deflection sensor interface 224. If the direction of the output signal has a positive slope or is rising, then the control system 206 determines if a new peak is detected (block 1006). If a new peak is detected, then the peak is filtered to eliminate any peaks due to noise or other signal interferences (block 1008). The order is set to a value of 1 (block 1010) and the control returns to block 914 of FIG. 9 (block 1012).

If a new peak is not detected, then the control system 206 determines if an inflection point of the output signal is detected (block 1014). In other words, the control system 206 determines if an inflection or a change in direction of the curve of the output signal is detected between the peak or trough values of the output signal. If an inflection point in the output signal is detected that is not a peak or trough value, then the value 1 is added to the order (block 1016) and the control then returns to block 914 of FIG. 9 (block 1012). If an inflection is not detected, then the control returns to block 914 of FIG. 9 (block 1012).

Figure 11:
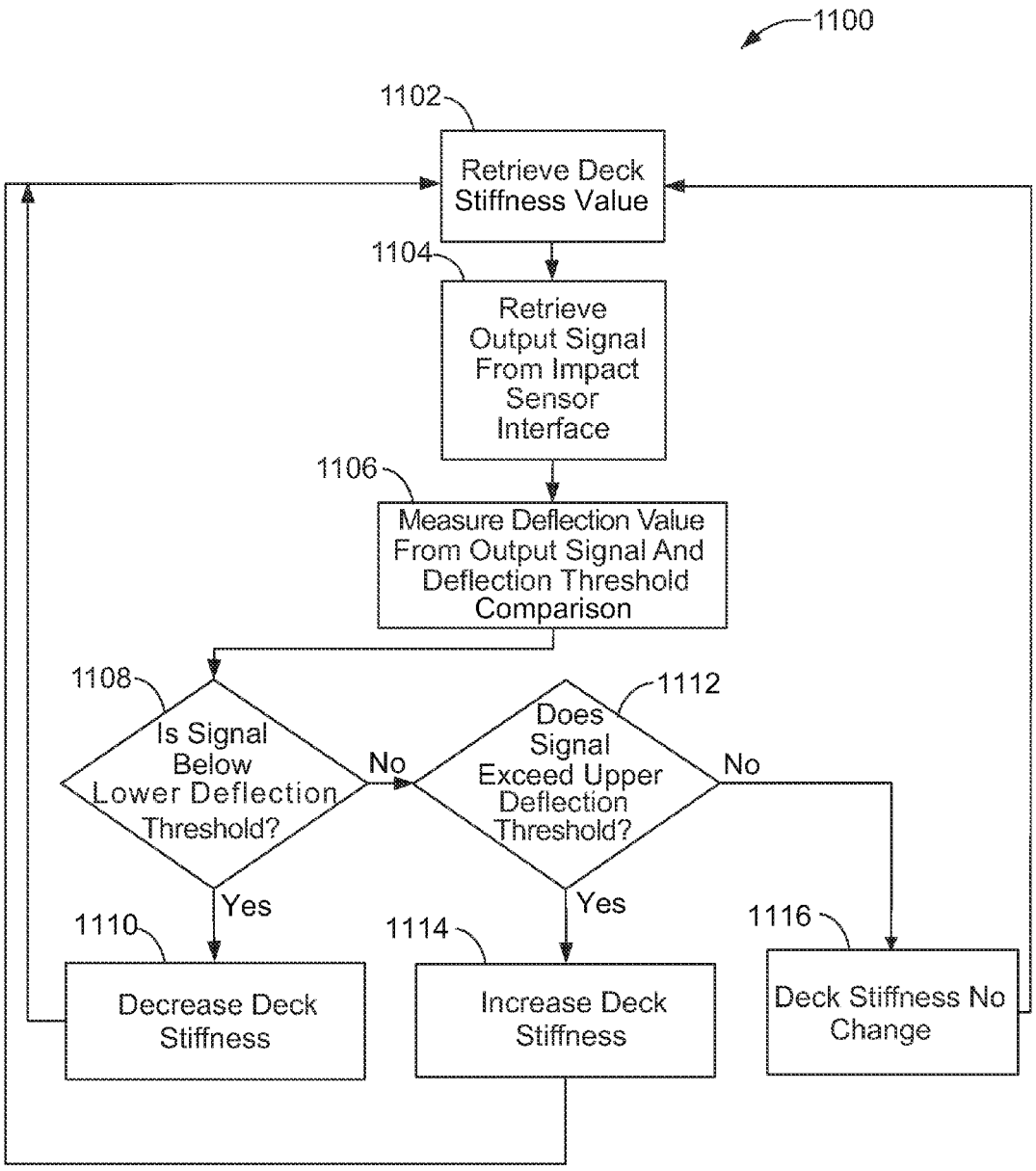
FIG. 11 illustrates an example flow diagram depicting an example process to determine the deck stiffness value.

FIG. 11 illustrates an example flow diagram depicting an example process 1100 to determine the deck stiffness value. The control system 226 receives the deck stiffness value (block 1102). The deck deflection stiffness value may be provided by the user via the user interface 202 and/or a deck deflection value may be retrieved from the data structure 238. For example, the data structure 238 may include look-up tables having deck deflection values determined from surveys, studies, etc., for a specific training or workout regimen based on a user's physical characteristics, the workout routine selected, and/or the deck deflection caused by a user impacting or exercising on the deck 104.

The control system 206 receives a signal output (block 1104) from the deflection sensor interface 224 and correlates the electrical signal output received to a deck deflection value or an amount or magnitude of force imparted on the deck 104 by a user's feet during the workout routine. As noted above, the derivative of the force magnitude over the heelstrike time provides the impacting loading or yank experienced by a user based on the user's physical characteristics and/or workout parameters. Because the biomechanics of running are well documented, reasonable estimates for the amount of time users feet are in heelstrike phase can be calculated based on the user's cadence (e.g., the cadence determined in FIG. 6). Thus, threshold deck deflection values may correlate to the impact loading magnitude ranges that are based on the deck deflection, a user's weight, speed, workout routine, and/or incline angle of the deck 104.

The threshold deck deflection values may be predetermined deflection values stored in the storage interface 234 or values retrieved from the data structure 238. The data structure 238 may include look-up tables having deck deflection threshold values and/or recommended deck stiffness values that are derived from research, surveys, studies, etc., based on the physical characteristics of a user such as, for example, a user's weight, height, inseam, fitness level, etc., and/or specific workout parameters selected by a user. For example, a user having a specific weight running on the treadmill 100 at a specific speed should set the deck stiffness value between upper and lower threshold deck stiffness or deflection values.

The comparator 240 receives the measured magnitude of the deck deflection from the output signal value and compares the measured deck deflection value with the threshold deck deflection values retrieved from the data structure 238 and the deck stiffness values received from the user interface 202 (block 1106). The control system 206 determines if the deflection magnitude value of the output signal for the given deck stiffness value received from the user interface 202 is less than a lower deck deflection threshold value (block 1108). If the measured deflection magnitude value is less than the threshold deflection value, the control system 206 prompts the device controller 234 to direct the deck stiffness adjustor 212 to decrease the stiffness of the deck 104 (block 1110). Alternatively, the control system 206 may prompt the user via the display 222 to manually decrease the deck stiffness value.

If the deflection magnitude is greater than the lower threshold deflection value, the control system 206 determines whether the measured deflection value exceeds an upper deflection threshold value (block 1112). If the measured deflection value exceeds the upper threshold deflection value, the control system 206 prompts the device controller 234 to direct the deck stiffness adjustor 212 to increase the stiffness of the deck 104 (block 1114). Alternatively, the control system 206 may prompt the user via the display 222 to manually increase the deck stiffness value. If the deflection value does not exceed the upper threshold deflection value, then the control system 206 directs the device controller 226 to keep the deck stiffness the same (block 1116). The control returns to block 1102 once the control system determines whether to decrease, increase, or keep the deck stiffness value the same. Additionally or alternatively, the device controller 236 may direct the deck stiffness adjustor to increase or decrease the deck stiffness value automatically.

Figure 12:
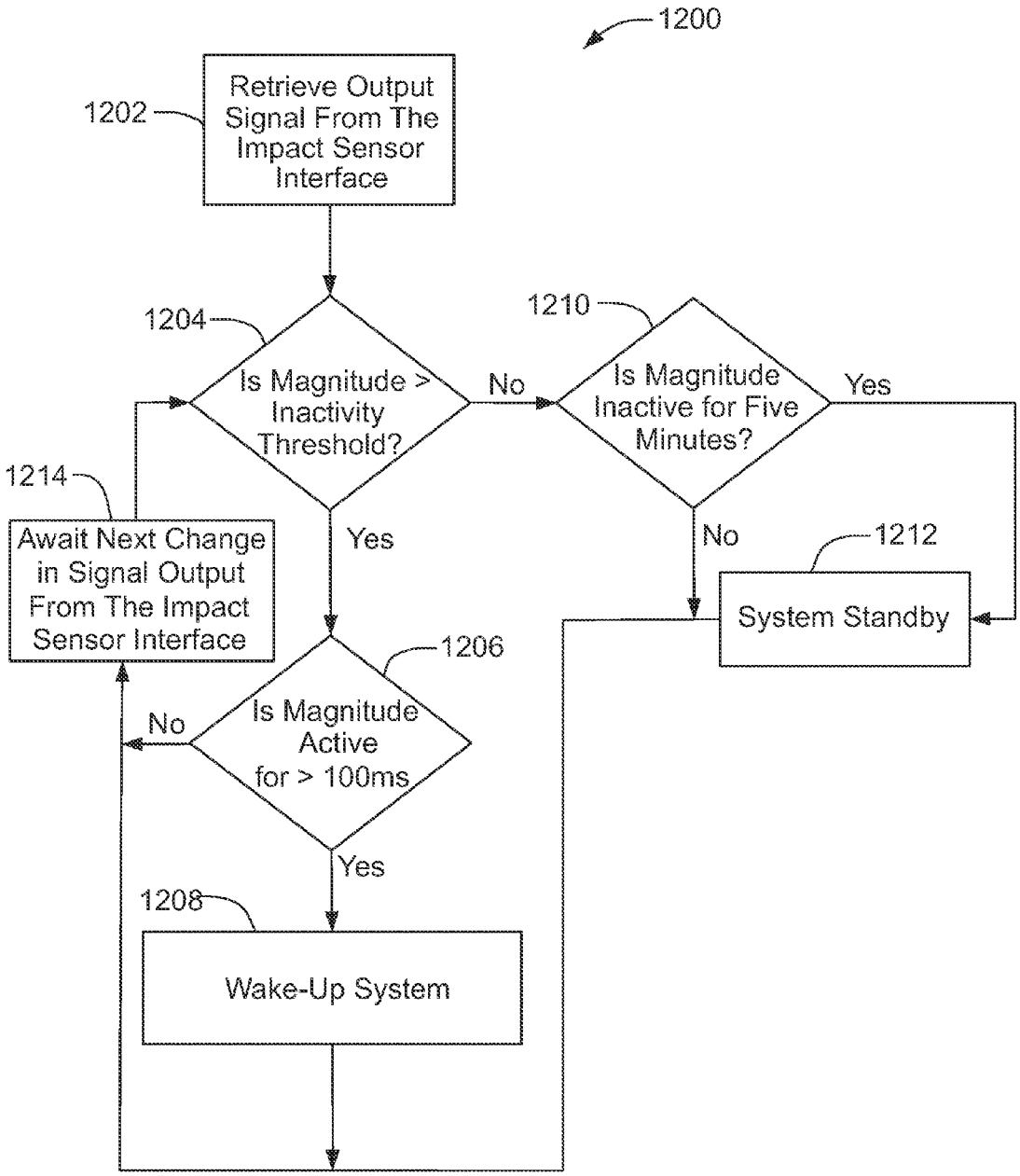
FIG. 12 illustrates an example flow diagram depicting an example process to activate the example exercise machine of FIG. 1 from standby status.

FIG. 12 illustrates an example flow diagram depicting an example process 1200 to activate the treadmill 100 from standby status. To determine whether to activate the treadmill 100 from standby status, the control system 206 receives the signal output from the deflection sensor interface 224 (block 1202). The signal output generated by the deflection sensor interface 224 correlates or is directly proportional to a force magnitude imparted on the deck 104 by the user's feet impacting the deck 104. The control system 206 determines whether the signal output is greater than an inactivity threshold value (block 1204). The inactivity threshold value may be retrieved from the data structure 238 and may be any suitable threshold value representing a force magnitude corresponding to a value that is less than the force magnitude values imparted on the deck 104 by the user's feet impacting the deck 104. If the force magnitude value is greater than the inactivity threshold, then the control system 206 determines whether the force magnitude value (i.e., the signal output) is active for more than a predetermined period of time such as, for example, one-hundred milliseconds (block 1206). If the deflection sensor interface 224 is active for greater than a predetermined period of time, then the control system 206 may cause the device controller 234 to activate the treadmill 100 from standby status (1208). For example, the device controller 234 may cause the backlight interface of the display 222 to illuminate so that a user may input information in the user interface 202. If the magnitude of the signal output is not active for more than the predetermined period of time (e.g., 100 milliseconds), then the control system 206 awaits the next change in the sensor output from the deflection sensor interface 224 (block 1214).

If the magnitude of the sensor signal is less than the inactivity threshold value, then the control sensor 206 determines if the output signal of the deflection sensor 224 is inactive for a second predetermined period of time such as, for example, a five-minute time interval (1210). If the sensor signal is inactive for a period of time greater than the predetermined period of time (e.g., five minutes), then the control system 206 directs the device controller 226 to inactive the treadmill 100 or return the treadmill 100 to standby status (block 1212). The control system 206 awaits the next change in sensor signal output from the deflection sensor interface 224 (block 1214). If the sensor signal is inactive for a period of time less than the predetermined period of time (e.g., five minutes), then the control system 206 awaits the next change in sensor signal output from the deflection sensor interface 224 (block 1214). The control then returns to block 1204.

Figure 13:
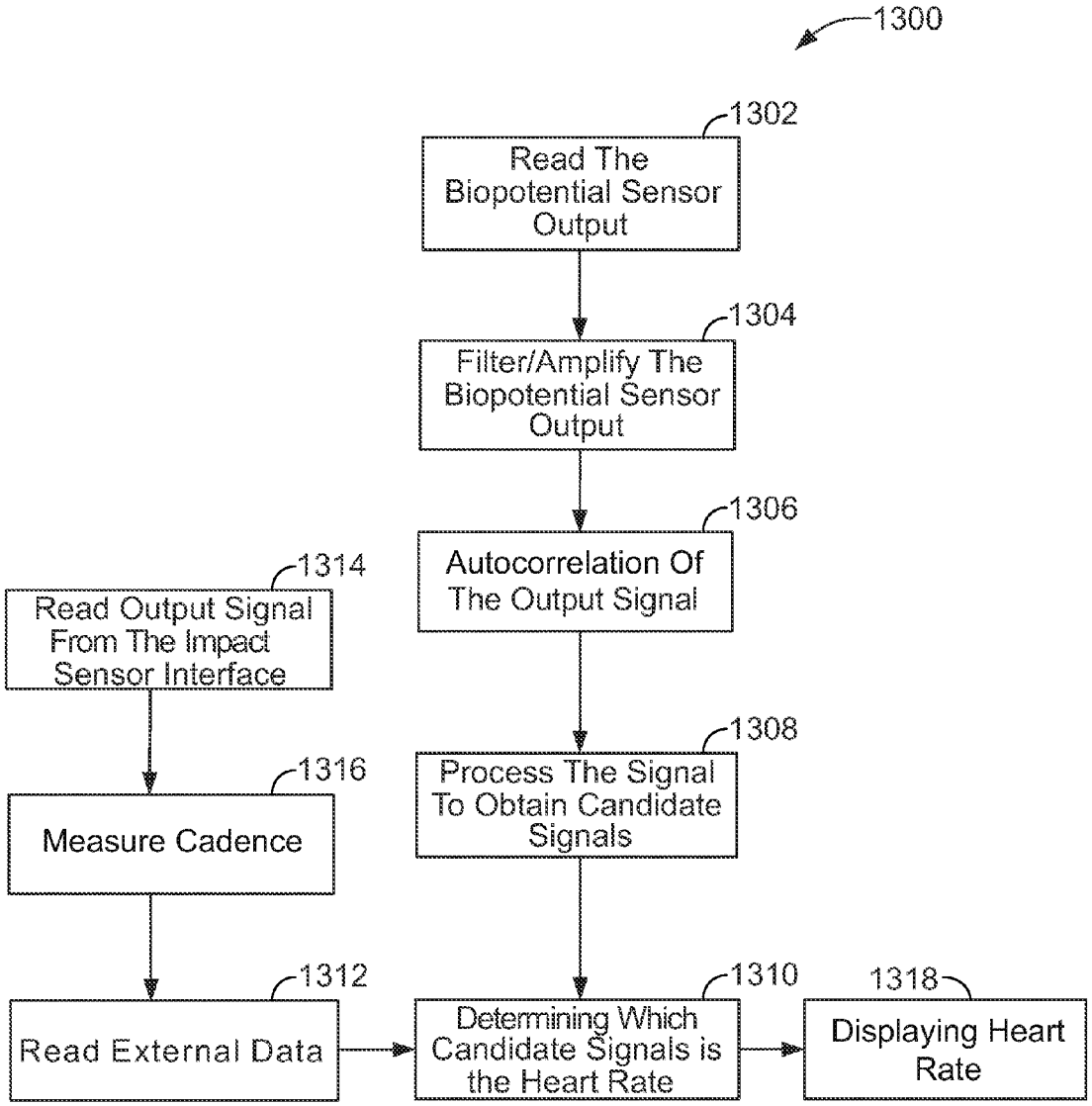
FIG. 13 illustrates an example flow diagram depicting an example process to determine the heart rate signals generated by biopotential signals of the example exercise machine of FIG. 1.

FIG. 13 is a block diagram of an example process 1300 to filter the noise generated by the user's cadence from the biopotential signals generated by the biopotential sensor interface 226. Methods and apparatus for measuring heart rates are described in U.S. Pat. No. 5,365,934, which is incorporated herein by reference in its entirety.

In general, the human body produces biopotential (i.e., electric) signals when muscles, including the heart, expand and contract. However, the electric signal also includes noise and signals corresponding to other functions such as, for example, a user's feet impacting the deck 104 during the exercise session (i.e., a user's cadence). For example, a user's cadence may be a regular repeating pattern that can generate electrical noise that may interfere with obtaining an accurate signal reading from the biopotential sensors. Referring to FIG. 16, the cadence of a user can often fall in or near the typical heart rate ranges, particularly at treadmill speeds above 2 miles per hour. Nonetheless, in many cases, there may be enough difference in cadence versus heart rate that a distinguishing condition helps to improve heart rate accuracy. For example, data from the graph of FIG. 16 indicates that a user has a cadence of 120 steps per minute during a 3 mph walk. However, her heart rate is typically around 105-110 beats per minute (bpm). If the heart rate algorithm was having trouble distinguishing between the heart rate signal and the noise from cadence, the condition to ignore the regular pattern at 120 steps per minute (i.e., cadence) would make the 110 beats per minute signal stand out more to facilitate detection.

The biopotential or electric signals are generated by the biopotential sensors (block 1302), for example, the biopotential sensor interface 226 of FIG. 2 that correspond to the beating of the user's heart. The output signal of the biopotential sensor interface 226 are filtered and amplified (block 1304). Autocorrelation of the filtered and amplified signals (block 1306) via, for example, an autocorrelator, determines the presence of a periodic signal. The output of the autocorrelator is used as an input to the data interface 232 of the control system 206, which detects the presence of periodic signals in the output of the autocorrelator and generates a number of candidate signals that correspond to heart rate measured in beats per minute (block 1308). The periodic signals are applied to, for example, an arbitrator, which uses predetermined criteria to decide which one of the candidate signals from block 1308 is most likely the user's true heart rate (block 1310). Such criteria can include the elapsed time which the user has been operating the treadmill 100, a value of the revolution per minute signal which indicates the effort being expended by the user, and the value of the previously selected candidate heart rates.

The arbitrator may take external data into account when selecting a heart rate signal (block 1312). For example, such external data may include signal outputs that are outside a predetermined range of a heart beat that are to be ignored because human beings typically have heart rates within known ranges (e.g., 50 to 200 beats per minute).

The signals generated by the deflection sensor interface 224 are receive by the control system 206 (Block 1314). As described above, such signals can be used to determine the cadence of the user (block 1316). The signals generated by the deflection sensor interface 224 may be stored as external data (block 1312). In this manner, the arbitrator may ignore the signals generated by the deflection sensor interface 224 when determining which candidate signals correlate to the user's heart rate (block 1310). By ignoring the sensors generated by the deflection sensor interface 224, the arbitrator can increase or improve accuracy when detecting the heart rate signals generated by the biopotential sensor interface 226. The heart rate selected by the arbitrator is displayed to the user via, for example, the display 222 (block 1318).

Although certain example methods, apparatus, and systems have been described herein, the scope of coverage of this patent is not limited thereto. On the contrary, this patent covers all methods, apparatus, systems, and articles of manufacture fairly falling within the scope of the appended claims either literally or under the doctrine of equivalents.

What is claimed is:

1. A method of determining cadence of a user exercising on a treadmill, the method comprising:

receiving output signals from a sensor generated in response to consecutive footfalls of the user impacting a deck of the treadmill during an exercise session;

processing the output signals from the sensor to determine respective magnitude values of a peak or a trough value of each of the output signals;

detecting whether a first output signal has a first peak or trough value and detecting whether a second output signal has a second peak or trough value;

determining a time interval between the first peak or trough value detected and the second peak or trough value detected; and calculating a cadence value of the user based on the time intervals.

2. A method as described in claim 1, further comprising providing a cadence training program to the user, the method comprising:

receiving a target cadence value;

comparing the calculated cadence value with the target cadence value;

in response to the calculated cadence value being less than the target cadence value, prompting the user to increase a speed of the treadmill or prompting the user to shorten a stride length if the calculated cadence value is less than the target cadence; and in response to the calculated cadence value being greater than the target cadence value, prompting the user to decrease the speed of the treadmill or prompting a user to lengthen a stride length if the calculated cadence value is greater than the target cadence.

3. A method as described in claim 2, wherein receiving the target cadence value comprises receiving the target cadence value from a user interface or a data structure having recommended cadence values based on a user's physical characteristics and workout parameters selected via the user interface.

4. A method as described in claim 2, further comprising directing a device controller to cause a speed adjustor to automatically increase or decrease the speed value of a drive member driving a belt of the treadmill.

5. A method as described in claim 2, further comprising determining a stride length of a user exercising on a treadmill, the method comprising:

receiving a speed value of a belt moving over a deck of the treadmill from a user interface or a speed sensor; and calculating a stride length value of a user by multiplying the time interval between the first and second peak or trough values of the first and second output signals by the speed value of the belt.

6. A method as defined in claim 5, further comprising comparing the calculated stride length value with a nominal stride length value, wherein the nominal stride length value is retrieved from a data structure having look-up tables that define average stride lengths based on a user's physical characteristics and workout parameters selected via a user interface.

7. A method as described in claim 2, further comprising adjusting a metabolic cost equation when the calculated cadence value is either less than or greater than the target cadence value.

8. A method as described in claim 7, wherein adjusting the metabolic cost equation comprises selecting a coefficient value from a data storage and multiplying the metabolic cost equation by the coefficient value.

9. A method as described in claim 8, wherein selecting the coefficient value comprises determining a delta value, wherein the delta value is based on a difference between a nominal stride length of the user retrieved from a storage interface and an average stride length retrieved from a data structure, and wherein the delta value and the speed are used to select the coefficient value from the data structure.

10. A method as described in claim 9, wherein the nominal stride length of the user is obtained by storing the calculated cadence value or the calculated stride length in a memory prior to prompting the user to either shorten or lengthen the stride and averaging the stored calculated cadence values or the calculated stride length.

11. A machine accessible medium having instructions stored thereon that, when executed, cause a machine to:

receive output signals from a sensor generated in response to consecutive footfalls of a user impacting a deck of a treadmill during an exercise session;

process the output signals from the sensor to determine respective magnitude values of a peak or a trough value of each of the output signals;

detect whether a first output signal has a first peak or trough value and detecting whether a second output signal has a second peak or trough value;

determine a time interval between the first peak or trough value detected and the second peak or trough value detected; and calculate a cadence value of the user based on the time interval.

12. A machine accessible medium as defined in claim 11 having instructions stored thereon that, when executed, cause the machine to store the calculated cadence value in memory.

13. A machine accessible medium as defined in claim 11 having instructions stored thereon that, when executed, cause the machine to receive a target cadence value, compare the calculated cadence value with the target cadence value, and in response to the calculated cadence value being less than the target cadence value, prompt the user to increase a speed of the treadmill or prompting the user to shorten a stride length, or in response to the calculated cadence value being greater than the target cadence value, prompt the user to decrease the speed of the treadmill or prompting the user to lengthen a stride length if the calculated cadence value is greater than the target cadence value.

14. A machine accessible medium as defined in claim 13 having instructions stored thereon that, when executed, cause the machine to receive the target cadence value from a user interface or a data structure having recommended cadence values based on a user's physical characteristics and workout parameters selected via the user interface.

15. A machine accessible medium as defined in claim 13 having instructions stored thereon that, when executed, cause the machine to direct a device controller to automatically increase or decrease the speed value of a drive member driving a belt.

16. A machine accessible medium as defined in claim 13 having instructions stored thereon that, when executed, cause the machine to prompt the user to shorten or lengthen the stride length of the user via a display.

17. A machine accessible medium as defined in claim 13 having instructions stored thereon that, when executed, cause the machine to receive a speed value of a belt moving over a deck of the treadmill from a user interface or a speed sensor, and multiply the time interval between the first and second peak or trough values of the first and second output signals by the speed value of the belt to determine a calculated stride length value of the user exercising on a treadmill.

18. A machine accessible medium as defined in claim 17, having instructions stored thereon that, when executed, cause the machine to store the calculated stride length value in a memory medium.

19. A machine accessible medium as defined in claim 17 having instructions stored thereon that, when executed, cause the machine to compare the calculated stride length with a nominal stride length, wherein the nominal stride length is retrieved from a data structure having look-up tables that define average stride lengths based on a user's physical characteristics and workout parameters selected via the user interface.

20. A machine accessible medium as defined in claim 13, having instructions stored thereon that, when executed, cause the machine to adjust a metabolic cost equation when the calculated cadence value is either less than or greater than the target cadence value.

21. A machine accessible medium as defined in claim 20, having instructions stored thereon that, when executed, cause the machine to select a coefficient value from a data storage and multiplying the metabolic cost equation by the coefficient value to adjust the metabolic cost equation.

22. A machine accessible medium as defined in claim 21, having instructions stored thereon that, when executed, cause the machine to determine a delta value based on a difference between the nominal stride length of the user retrieved from a storage interface and an average stride length retrieved from a data structure, and wherein the delta value and the speed are used to select the coefficient value from the data structure.

23. A machine accessible medium as defined in claim 22, having instructions stored thereon that, when executed, cause the machine to determine the nominal stride length of the user by storing the calculated cadence value or the calculated stride length in a memory prior to prompting the user to either shorten or lengthen the stride and averaging the stored calculated cadence value or the calculated stride length to determine the nominal stride length.

24. A system for profiling an exercise session of an exercise machine, comprising:

a user interface to enable a user to input physical characteristics or workout parameters;

sensors operatively coupled to the exercise machine to generate output signals in response to a user impacting the exercise machine during the exercise session, the sensors to produce output signals that are proportional to magnitudes of forces imparted on the exercise machine by the user during the exercise session; and a control system to process the output signals to determine peak or trough values of the output signals, the control system to detect whether a first output signal has a first peak or trough value and detect whether a second output signal has a second peak or trough value, the control system to determine a time interval between the first peak or trough value detected and the second peak or trough value detected and calculate a cadence value of the user based on the time interval.

25. A system as described in claim 24 wherein the sensors comprise piezoelectric sensors.

* * * * *